US010569532B2

(12) United States Patent
Shmaiser et al.

(10) Patent No.: US 10,569,532 B2
(45) Date of Patent: Feb. 25, 2020

(54) DIGITAL PRINTING SYSTEM

(71) Applicant: LANDA CORPORATION LTD., Rehovot (IL)

(72) Inventors: Aharon Shmaiser, Rishon LeZion (IL); Benzion Landa, Nes Ziona (IL); Sagi Moskovich, Petach Tikva (IL); Nir Zarmi, Be'erotayim (IL); Yehuda Solomon, Rishon LeZion (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 16/203,472

(22) Filed: Nov. 28, 2018

(65) Prior Publication Data

US 2019/0168502 A1 Jun. 6, 2019

Related U.S. Application Data

(63) Continuation of application No. 15/871,652, filed on Jan. 15, 2018, now Pat. No. 10,179,447, which is a (Continued)

(30) Foreign Application Priority Data

Sep. 11, 2013 (GB) ..... 1316203.7

(51) Int. Cl.

| | |
|---|---|
| ***B41J 2/005*** | (2006.01) |
| ***B41J 3/60*** | (2006.01) |
| ***B41J 2/01*** | (2006.01) |

(52) U.S. Cl.

CPC ..... *B41J 2/0057* (2013.01); *B41J 2/005* (2013.01); *B41J 3/60* (2013.01); *B41J 2002/012* (2013.01)

(58) Field of Classification Search

CPC ... B41J 2/0057; B41J 2/005; B41J 3/60; B41J 2002/012

See application file for complete search history.

(56) References Cited

U.S. PATENT DOCUMENTS

| | | | |
|---|---|---|---|
| 3,697,568 | A | 10/1972 | Boissieras et al. |
| 3,889,802 | A | 6/1975 | Jonkers et al. |

(Continued)

FOREIGN PATENT DOCUMENTS

| | | | |
|---|---|---|---|
| CN | 1200085 | A | 11/1998 |
| CN | 1493514 | A | 5/2004 |

(Continued)

OTHER PUBLICATIONS

IP.com search (Year: 2019).*

(Continued)

*Primary Examiner* — Lisa Solomon
(74) *Attorney, Agent, or Firm* — Marc Van Dyke

(57) ABSTRACT

A printing system for printing on a substrate. In embodiments, the system comprises: a movable intermediate transfer member in the form of a flexible, substantially inextensible, thin belt whose compressible layer has a thickness of at most 400 micrometers, the belt being guided to follow a closed path, an image forming station for depositing ink droplets onto an outer surface of the belt to form an ink image, a drying station for drying the ink image to leave an ink residue film, first and second impression stations spaced from one another in the direction of movement of the belt, each impression station comprising an impression cylinder for supporting and transporting the substrate and a pressure cylinder carrying a thick compressible blanket for urging the belt against the substrate supported on the impression cylinder, a thickness of the compressible blanket being at least 1 mm.

12 Claims, 9 Drawing Sheets

Related U.S. Application Data continuation of application No. 15/287,585, filed on Oct. 6, 2016, now Pat. No. 9,902,147, which is a continuation-in-part of application No. 14/917,020, filed as application No. PCT/IB2014/064277 on Sep. 5, 2014, now Pat. No. 9,505,208, said application No. 15/287,585 is a continuation-in-part of application No. 14/382,756, filed as application No. PCT/IB2013/051717 on Mar. 5, 2013, now Pat. No. 9,568,862.

(60) Provisional application No. 61/640,493, filed on Apr. 30, 2012, provisional application No. 61/635,156, filed on Apr. 18, 2012, provisional application No. 61/619,546, filed on Apr. 3, 2012, provisional application No. 61/619,016, filed on Apr. 2, 2012, provisional application No. 61/611,286, filed on Mar. 15, 2012, provisional application No. 61/606,913, filed on Mar. 5, 2012.

(56) References Cited

U.S. PATENT DOCUMENTS 4,642,654 A 2/1987 Toganoh et al.
5,264,904 A 11/1993 Audi et al.
5,349,905 A 9/1994 Taylor et al.
5,365,324 A 11/1994 Gu et al.
5,532,314 A 7/1996 Sexsmith et al.
5,889,534 A 3/1999 Johnson et al.
5,991,590 A 11/1999 Chang et al.
6,045,817 A 4/2000 Ananthapadmanabhan et al.
6,072,976 A 6/2000 Kuriyama et al.
6,078,775 A 6/2000 Arai et al.
6,094,558 A 7/2000 Shimizu et al.
6,109,746 A 8/2000 Jeanmaire et al.
6,261,688 B1 7/2001 Kaplan et al.
6,357,869 B1 3/2002 Rasmussen et al.
6,400,913 B1 6/2002 De Jong et al.
6,554,189 B1 4/2003 Good et al.
6,811,840 B1 11/2004 Cross
6,881,458 B2 4/2005 Ludwig et al.
6,966,712 B2 11/2005 Trelewicz et al.
6,983,692 B2 1/2006 Beauchamp et al.
7,025,453 B2 4/2006 Ylitalo et al.
7,213,900 B2 5/2007 Ebihara
7,265,819 B2 9/2007 Raney
7,334,520 B2 2/2008 Geissler et al.
7,575,314 B2 8/2009 Desie et al.
8,038,284 B2 10/2011 Hori et al.
8,122,846 B2 2/2012 Stiblert et al.
8,162,428 B2 4/2012 Eun et al.
8,353,589 B2 1/2013 Ikeda et al.
8,434,847 B2 5/2013 Dejong et al.
8,469,476 B2 6/2013 Mandel et al.
8,867,097 B2 10/2014 Mizuno
8,885,218 B2 11/2014 Hirose
8,891,128 B2 11/2014 Yamazaki
9,004,629 B2 4/2015 De Jong et al.
9,264,559 B2 2/2016 Motoyanagi et al.
9,284,469 B2 3/2016 Song et al.
9,446,586 B2 9/2016 Matos et al.
9,782,993 B2 10/2017 Landa et al.
9,884,479 B2 2/2018 Landa et al.
10,065,411 B2 9/2018 Landa et al.
10,179,447 B2 1/2019 Shmaiser et al.
10,190,012 B2 1/2019 Landa et al.
2002/0041317 A1 4/2002 Kashiwazaki et al.
2002/0121220 A1 9/2002 Lin
2003/0030686 A1 2/2003 Abe et al.
2003/0043258 A1 3/2003 Kerr et al.
2003/0054139 A1 3/2003 Ylitalo et al.
2003/0063179 A1 4/2003 Adachi
2003/0081964 A1 5/2003 Shimura et al.
2004/0047666 A1 3/2004 Imaizumi et al.
2004/0123761 A1 7/2004 Szumla et al.
2004/0125188 A1 7/2004 Szumla et al.
2004/0173111 A1 9/2004 Okuda
2004/0246326 A1 12/2004 Dwyer et al.
2005/0031807 A1 2/2005 Quintens et al.
2005/0195235 A1 9/2005 Kitao
2005/0272334 A1 12/2005 Wang et al.
2006/0004123 A1 1/2006 Wu et al.
2006/0164489 A1 7/2006 Vega et al.
2006/0192827 A1 8/2006 Takada et al.
2006/0286462 A1 12/2006 Jackson et al.
2007/0025768 A1 2/2007 Komatsu et al.
2007/0054981 A1 3/2007 Yanagi et al.
2007/0120927 A1 5/2007 Snyder et al.
2007/0123642 A1 5/2007 Banning et al.
2007/0144368 A1 6/2007 Barazani et al.
2007/0147894 A1 6/2007 Yokota et al.
2007/0166071 A1 7/2007 Shima
2007/0199457 A1 8/2007 Cyman, Jr. et al.
2008/0055356 A1 3/2008 Yamanobe
2008/0112912 A1 5/2008 Springob et al.
2008/0175612 A1 7/2008 Oikawa et al.
2008/0213548 A1 9/2008 Koganehira et al.
2008/0236480 A1 10/2008 Furukawa et al.
2008/0253812 A1 10/2008 Pearce et al.
2009/0148200 A1 6/2009 Hara et al.
2009/0220873 A1 9/2009 Enomoto et al.
2009/0279170 A1 11/2009 Miyazaki et al.
2010/0053292 A1 3/2010 Thayer et al.
2010/0053293 A1 3/2010 Thayer et al.
2010/0111577 A1 5/2010 Soria et al.
2010/0231623 A1 9/2010 Hirato
2010/0239789 A1 9/2010 Umeda
2011/0128300 A1 6/2011 Gay et al.
2011/0150509 A1 6/2011 Komiya
2011/0249090 A1 10/2011 Moore et al.
2012/0013693 A1 1/2012 Tasaka et al.
2012/0094091 A1 4/2012 Van Mil et al.
2012/0105562 A1 5/2012 Sekiguchi et al.
2012/0156624 A1 6/2012 Rondon et al.
2012/0163846 A1 6/2012 Andoh et al.
2012/0301186 A1 11/2012 Yang et al.
2012/0314077 A1 12/2012 Clavenna, II et al.
2013/0044188 A1 2/2013 Nakamura et al.
2013/0057603 A1 3/2013 Gordon
2013/0120513 A1 5/2013 Thayer et al.
2013/0201237 A1 8/2013 Thomson et al.
2013/0242016 A1 9/2013 Edwards et al.
2014/0001013 A1 1/2014 Takifuji et al.
2014/0011125 A1 1/2014 Inoue et al.
2014/0232782 A1 8/2014 Mukai et al.
2014/0267777 A1 9/2014 Le Clerc et al.
2015/0085036 A1 3/2015 Liu et al.
2015/0085037 A1 3/2015 Liu et al.
2015/0195509 A1 7/2015 Phipps
2015/0210065 A1 7/2015 Kelly et al.
2015/0304531 A1 10/2015 Rodriguez Garcia et al.
2016/0222232 A1 8/2016 Landa et al.
2016/0286462 A1 9/2016 Gohite et al.
2016/0297190 A1 10/2016 Landa et al.
2016/0297978 A1 10/2016 Landa et al.
2017/0028688 A1 2/2017 Dannhauser et al.
2017/0104887 A1 4/2017 Nomura
2017/0244956 A1 8/2017 Stiglic et al.
2018/0093470 A1 4/2018 Landa et al.
2018/0259888 A1 9/2018 Mitsui et al.
2019/0023000 A1 1/2019 Landa et al.
2019/0023919 A1 1/2019 Landa et al.
2019/0084295 A1 3/2019 Shmaiser et al.
2019/0256724 A1 8/2019 Landa et al.

FOREIGN PATENT DOCUMENTS

CN 1809460 A 7/2006
CN 101873982 A 10/2010
CN 102555450 A 7/2012
CN 103991293 A 8/2014
CN 104618642 A 5/2015
EP 0499857 A1 8/1992

(56) References Cited

FOREIGN PATENT DOCUMENTS

| | | | |
|---|---|---|---|
| EP | 0606490 | A1 | 7/1994 |
| EP | 0609076 | A2 | 8/1994 |
| EP | 0530627 | B1 | 3/1997 |
| EP | 0854398 | A2 | 7/1998 |
| EP | 1146090 | A2 | 10/2001 |
| EP | 0825029 | B1 | 5/2002 |
| EP | 1247821 | A2 | 10/2002 |
| EP | 0867483 | B1 | 6/2003 |
| EP | 1454968 | A1 | 9/2004 |
| EP | 1503326 | A1 | 2/2005 |
| EP | 2042317 | A1 | 4/2009 |
| EP | 2065194 | A2 | 6/2009 |
| EP | 2228210 | A1 | 9/2010 |
| EP | 2042318 | B1 | 2/2011 |
| EP | 2042325 | B1 | 2/2012 |
| EP | 2683556 | A1 | 1/2014 |
| EP | 2075635 | B1 | 10/2014 |
| GB | 748821 | A | 5/1956 |
| GB | 1496016 | A | 12/1977 |
| GB | 1522175 | A | 8/1978 |
| GB | 2321430 | A | 7/1998 |
| JP | S5578904 | A | 6/1980 |
| JP | S6076343 | A | 4/1985 |
| JP | S60199692 | A | 10/1985 |
| JP | H05297737 | A | 11/1993 |
| JP | H06100807 | A | 4/1994 |
| JP | H06171076 | A | 6/1994 |
| JP | H06345284 | A | 12/1994 |
| JP | H07186453 | A | 7/1995 |
| JP | H07238243 | A | 9/1995 |
| JP | H0862999 | A | 3/1996 |
| JP | H08112970 | A | 5/1996 |
| JP | 2529651 | B2 | 8/1996 |
| JP | H09123432 | A | 5/1997 |
| JP | H09281851 | A | 10/1997 |
| JP | H09314867 | A | 12/1997 |
| JP | H11106081 | A | 4/1999 |
| JP | 2000108320 | A | 4/2000 |
| JP | 2000108334 | A | 4/2000 |
| JP | 2000206801 | A | 7/2000 |
| JP | 2002304066 | A | 10/2002 |
| JP | 2003219271 | A | 7/2003 |
| JP | 2003246135 | A | 9/2003 |
| JP | 2003292855 | A | 10/2003 |
| JP | 2004009632 | A | 1/2004 |
| JP | 2004019022 | A | 1/2004 |
| JP | 2004025708 | A | 1/2004 |
| JP | 2004034441 | A | 2/2004 |
| JP | 2004077669 | A | 3/2004 |
| JP | 2004148687 | A | 5/2004 |
| JP | 2004524190 | A | 8/2004 |
| JP | 2004261975 | A | 9/2004 |
| JP | 2004325782 | A | 11/2004 |
| JP | 2005114769 | A | 4/2005 |
| JP | 2005215247 | A | 8/2005 |
| JP | 2005319593 | A | 11/2005 |
| JP | 2006001688 | A | 1/2006 |
| JP | 2006095870 | A | 4/2006 |
| JP | 2006143778 | A | 6/2006 |
| JP | 2006152133 | A | 6/2006 |
| JP | 2006243212 | A | 9/2006 |
| JP | 2006263984 | A | 10/2006 |
| JP | 2006347085 | A | 12/2006 |
| JP | 2007041530 | A | 2/2007 |
| JP | 2007253347 | A | 10/2007 |
| JP | 2008137239 | A | 6/2008 |
| JP | 2008246990 | A | 10/2008 |
| JP | 2009045851 | A | 3/2009 |
| JP | 2009083314 | A | 4/2009 |
| JP | 2009148908 | A | 7/2009 |
| JP | 2010184376 | A | 8/2010 |
| JP | 2010214885 | A | 9/2010 |
| JP | 2010234681 | A | 10/2010 |
| JP | 2010247381 | A | 11/2010 |
| JP | 2010247528 | A | 11/2010 |
| JP | 2010260287 | A | 11/2010 |
| JP | 2010260302 | A | 11/2010 |
| JP | 2011002532 | A | 1/2011 |
| JP | 2011126031 | A | 6/2011 |
| JP | 2011133884 | A | 7/2011 |
| JP | 2011144271 | A | 7/2011 |
| JP | 2011189627 | A | 9/2011 |
| JP | 2011201951 | A | 10/2011 |
| RU | 2180675 | C2 | 3/2002 |
| RU | 2282643 | C1 | 8/2006 |
| WO | WO-9604339 | A1 | 2/1996 |
| WO | WO-9631809 | A1 | 10/1996 |
| WO | WO-9707991 | A1 | 3/1997 |
| WO | 9912633 | A1 | 3/1999 |
| WO | WO-9942509 | A1 | 8/1999 |
| WO | WO-9943502 | A2 | 9/1999 |
| WO | WO-0154902 | A1 | 8/2001 |
| WO | WO-02068191 | A1 | 9/2002 |
| WO | WO-02078868 | A2 | 10/2002 |
| WO | WO-02094912 | A1 | 11/2002 |
| WO | WO-2006051733 | A1 | 5/2006 |
| WO | WO-2007145378 | A1 | 12/2007 |
| WO | WO-2008078841 | A1 | 7/2008 |
| WO | WO-2009134273 | A1 | 11/2009 |
| WO | 2010073916 | A1 | 7/2010 |
| WO | WO-2010042784 | A3 | 7/2010 |
| WO | WO-2011142404 | A1 | 11/2011 |
| WO | WO-2012014825 | A1 | 2/2012 |
| WO | WO-2012148421 | A1 | 11/2012 |
| WO | WO-2013060377 | A1 | 5/2013 |
| WO | WO-2013132340 | A1 | 9/2013 |
| WO | WO-2013132343 | A1 | 9/2013 |
| WO | WO-2013132345 | A1 | 9/2013 |
| WO | WO-2013132438 | A2 | 9/2013 |
| WO | WO-2013132439 | A1 | 9/2013 |
| WO | WO-2015036906 | A1 | 3/2015 |
| WO | WO-2016166690 | A1 | 10/2016 |

OTHER PUBLICATIONS

"Amino Functional Silicone Polymers", in Xiameter.Copyrgt. 2009 Dow Corning Corporation.

Clariant, "Ultrafine Pigment Dispersion for Design and Creative Materials : Hostafine Pigment Preparation" Retrieved from the Internet : URL: http://www.clariant.com/C125720D002B963C/4352D0BC052E90CEC1257479002707D9/$FILE/DP6208E_0608_FL_Hostafinefordesignandcreativematerials.pdf Jun. 19, 2008.

CN101873982A Machine Translation (by EPO and Google)—published Oct. 27, 2010; Habasit AG, Delair et al.

CN102555450A Machine Translation (by EPO and Google)—published Jul. 11, 2012; Fuji Xerox Co., Ltd, Motoharu et al.

CN103991293A Machine Translation (by EPO and Google)—published Aug. 20, 2014; Miyakoshi Printing Machinery Co., Ltd, Junichi et al.

CN104618642 Machine Translation (by EPO and Google); published on May 13, 2015, Yulong Comp Comm Tech Shenzhen.

CN1493514A Machine Translation (by EPO and Google)—published May 5, 2004; GD SPA, Boderi et al.

Co-pending U.S. Appl. No. 16/219,582, filed Dec. 13, 2018.

Co-pending U.S. Appl. No. 16/220,193, filed Dec. 14, 2018.

Co-pending U.S. Appl. No. 16/226,726, filed Dec. 20, 2018.

Co-pending U.S. Appl. No. 16/231,693, filed Dec. 24, 2018.

Co-pending U.S. Appl. No. 16/258,758, filed Jan. 28, 2019.

Co-pending U.S. Appl. No. 16/303,613, filed Nov. 20, 2018.

Co-pending U.S. Appl. No. 16/303,615, filed Nov. 20, 2018.

Co-pending U.S. Appl. No. 16/303,631, filed Nov. 20, 2018.

Epomin Polyment, product information from Nippon Shokubai, dated Feb. 28, 2014.

Handbook of Print Media, 2001, Springer Verlag, Berlin/Heidelberg/New York, pp. 127-136,748—With English Translation.

JP2000108320 Machine Translation (by PlatPat English machine translation)—published Apr. 18, 2000 Brother Ind. Ltd.

JP2000206801 Machine Translation (by PlatPat English machine translation); published on Jul. 28, 2000, Canon KK, Kobayashi et al.

(56) References Cited

OTHER PUBLICATIONS

JP2002304066A Machine Translation (by EPO and Google)—published Oct. 18, 2002; PFU LTD.
JP2003219271 Machine Translation (by EPO and Google); published on Jul. 31, 2003, Japan Broadcasting.
JP2003246135 Machine Translation (by PlatPat English machine translation)—published Sep. 2, 2003 Ricoh KK, Morohoshi et al.
JP2003292855(A) Machine Translation (by EPO and Google)—published Oct. 15, 2003; Konishiroku Photo Ind.
JP2004009632(A) Machine Translation (by EPO and Google)—published Jan. 15, 2004; Konica Minolta Holdings Inc.
JP2004019022 Machine Translation (by EPO and Google)—published Jan. 22, 2004; Yamano et al.
JP2004025708(A) Machine Translation (by EPO and Google)—published Jan. 29, 2004; Konica Minolta Holdings Inc.
JP2004034441(A) Machine Translation (by EPO and Google)—published Feb. 5, 2004; Konica Minolta Holdings Inc.
JP2004077669 Machine Translation (by PlatPat English machine translation)—published Mar. 11, 2004 Fuji Xerox Co Ltd.
JP2004148687A Machine Translation (by EPO and Google)—published May 27, 2014; Mitsubishi Heavy Ind Ltd.
JP2004261975 Machine Translation (by EPO, PlatPat and Google); published on Sep. 24, 2004, Seiko Epson Corp, Kataoka et al.
JP2004325782A Machine Translation (by EPO and Google)—published Nov. 18, 2004; Canon KK.
JP2005114769 Machine Translation (by PlatPat English machine translation)—published Apr. 28, 2005 Ricoh KK.
JP2005215247A Machine Translation (by EPO and Google)—published Aug. 11, 2005; Toshiba Corp.
JP2006001688 Machine Translation (by PlatPat English machine translation)—published Jan. 5, 2006 Ricoh KK.
JP2006095870(A) Machine Translation (by EPO and Google)—published Apr. 13, 2006; Fuji Photo Film Co Ltd.
JP2006-143778 Machine Translation (by EPO, PlatPat and Google)—published Jun. 8, 2006 Sun Bijutsu Insatsu KK et al.
JP2006-152133 Machine Translation (by EPO, PlatPat and Google)—published Jun. 15, 2006 Seiko Epson Corp.
JP2006243212 Machine Translation (by PlatPat English machine translation)—published Sep. 14, 2006 Fuji Xerox Co Ltd.
JP2006-263984 Machine Translation (by EPO, PlatPat and Google)—published Oct. 5, 2006 Fuji Photo Film Co Ltd.
JP2006-347085 Machine Translation (by EPO and Google)—published Dec. 28, 2006 Fuji Xerox Co Ltd.
JP2007041530A Machine Translation (by EPO and Google)—published Feb. 15, 2007; Fuji Xerox Co Ltd.
JP2009-083314 Machine Translation (by EPO, PlatPat and Google)—published Apr. 23, 2009 Fujifilm Corp.
JP2009148908A Machine Translation (by EPO and Google)—published Jul. 9, 2009; Fuji Xerox Co Ltd.
JP2010-184376 Machine Translation (by EPO, PlatPat and Google)—published Aug. 26, 2010 Fujifilm Corp.
JP2010214885A Machine Translation (by EPO and Google)—published Sep. 30, 2010; Mitsubishi Heavy Ind Ltd.
JP2011002532 Machine Translation (by PlatPat English machine translation)—published Jun. 1, 2011 Seiko Epson Corp.
JP2011-144271 Machine Translation (by EPO and Google)—published Jun. 28, 2011 Toyo Ink SC Holdings Co Ltd.
JP2011189627 Machine Translation (by Google Patents)—published Sep. 29, 2011; Canon KK.
JP2011201951(A) Machine Translation (by PlatPat English machine translation); published on Oct. 13, 2011, Shin-Etsu Chemical Co Ltd, Todoroki et al.
JPH06100807 Machine Translation (by EPO and Google)—published Apr. 12, 1994; Seiko Instr Inc.
JPH07238243(A) Machine Translation (by EPO and Google)—published Sep. 12, 1995; Seiko Instr Inc.
JPH08112970 Machine Translation (by EPO and Google)—published May 7, 1996; Fuji Photo Film Co Ltd.
JPH0862999(A) Machine Translation (by EPO & Google)—published Mar. 8, 1996 Toray Industries, Yoshida, Tomoyuki.
JPH09281851A Machine Translation (by EPO and Google)—published Oct. 31, 1997; Seiko Epson Corp.
JPH09314867A Machine Translation (by PlatPat English machine translation)—published Dec. 9, 1997, Toshiba Corp.
JPH11106081A Machine Translation (by EPO and Google)—published Apr. 20, 1999; Ricoh KK.
JPH5-297737 Machine Translation (by EPO & Google machine translation)—published Nov. 12, 1993 Fuji Xerox Co Ltd.
JPS6076343A Machine Translation (by EPO and Google)—published Apr. 30, 1985; Toray Industries.
Marconi Studios, Virtual SET Real Time; http://www.marconistudios.il/pages/virtualset_en.php.
"Solubility of Alcohol", in http://www.solubilityoflhings.com/water/alcohol; downloaded on Nov. 30, 2017.
Poly(vinyl acetate) data sheet. PolymerProcessing.com. Copyright 2010. http://polymerprocessing .com/polymers/PV AC.html.
Royal Television Society, The Flight of the Phoenix; https://rts.org.uk/article/flight-phoenix, Jan. 27, 2011.
RU2180675 Machine Translation (by EPO and Google)—published Mar. 20, 2002; Zao Rezinotekhnika.
RU2282643 Machine Translation (by EPO and Google)—published Aug. 27, 2006; Balakovorezinotekhnika AOOT.
JP2004524190A Machine Translation (by EPO and Google)—published Aug. 12, 2004; Avery Dennison Corp.
JP2010234681A Machine Translation (by EPO and Google)—published Oct. 21, 2010; Riso Kagaku Corp.
JP2010260302A Machine Translation (by EPO and Google)—published Nov. 18, 2010; Riso Kagaku Corp.
JPH06171076A Machine Translation (by PlatPat English machine translation)—published Jun. 21, 1994, Seiko Epson Corp.
JPS60199692A Machine Translation (by Epo and Google)—published Oct. 9, 1985; Suwa Seikosha KK.
WO2006051733A1 Machine Translation (by EPO and Google)—published May 18, 2006; Konica Minolta Med & Graphic.
CN1809460A Machine Translation (by EPO and Google)—published Jul. 26, 2006; Canon KK.
JP2007253347A Machine Translation (by EPO and Google)—published Oct. 4, 2007; Ricoh KK, Matsuo et al.
JP2529651(B2)Machine Translation (by EPO and Google)—issued Aug. 28, 1996; Osaka Sealing Insatsu KK.
Units of Viscosity' published by Hydramotion Ltd. 1 York Road Park, Malton, York Y017 6YA, England; downloaded from www.hydramotion.com website on Jun. 19, 2017.
Co-pending U.S. Appl. No. 16/432,934, filed Jun. 6, 2019.
Co-pending U.S. Appl. No. 16/433,970, filed Jun. 6, 2019.
Co-pending U.S. Appl. No. 16/512,915, filed Jul. 16, 2019.
Co-pending U.S. Appl. No. 16/542,362, filed Aug. 16, 2016.
Flexicon., "Bulk Handling Equipment and Systems: Carbon Black," 2018, 2 pages.
JP2000108334A Machine Translation (by EPO and Google)—published Apr. 18, 2000; Brother Ind Ltd.
JP2005319593 Machine Translation (by EPO and Google)—published Nov. 17, 2005, Jujo Paper Co Ltd.
JP2008137239A Machine Translation (by EPO and Google); published on Jun. 19, 2008, Kyocera Mita Corp.
JP2008246990 Machine Translation (by EPO and Google)—published Oct. 16, 2008, Jujo Paper Co Ltd.
JP2009045851A Machine Translation (by EPO and Google); published on Mar. 5, 2009, Fujifilm Corp.
JP2010247381A Machine Translation (by EPO and Google); published on Nov. 4, 2010, Ricoh Co Ltd.
JP2010260287 Machine Translation (by EPO and Google)—published Nov. 18, 2010, Canon KK.
JP2011126031A Machine Translation (by EPO and Google); published on Jun. 30, 2011, Kao Corp.
JPH06345284A Machine Translation (by EPO and Google); published on Dec. 20, 1994, Seiko Epson Corp.
JPH07186453A Machine Translation (by EPO and Google)—published Jul. 25, 1995; Toshiba Corp.
JPH09123432 Machine Translation (by EPO and Google)—published May 13, 1997, Mita Industrial Co Ltd.
JPS5578904A Machine Translation (by Epo and Google)—published Jun. 14, 1980; Yokoyama Haruo.

(56) References Cited

OTHER PUBLICATIONS

Montuori G.M., et al., "Geometrical Patterns for Diagrid Buildings: Exploring Alternative Design Strategies From the Structural Point of View," Engineering Structures, Jul. 2014, vol. 71, pp. 112-127.
Technical Information Lupasol Types, Sep. 2010, 10 pages.
The Engineering Toolbox., "Dynamic Viscosity of Common Liquids," 2018, 4 pages.
WO2010073916A1 Machine Translation (by EPO and Google)—published Jul. 1, 2010; Nihon Parkerizing [JP] et al.

* cited by examiner

DIGITAL PRINTING SYSTEM

REFERENCE TO RELATED APPLICATIONS

The present application is a continuation of U.S. patent application Ser. No. 15/871,652 filed on Jan. 15, 2018, which is incorporated by reference as if full set forth herein. U.S. patent application Ser. No. 15/871,652 is a Continuation of U.S. patent application Ser. No. 15/287,585, filed on Oct. 10, 2016, which is incorporated by reference as if full set forth herein. U.S. patent application Ser. No. 15/287,585 is a Continuation in Part (CIP) of U.S. patent application Ser. No. 14/917,020, filed Mar. 6, 2016 and entitled "Digital Printing System", which is a National Phase Entry of PCT Application PCT/IB2014/164277 filed Sep. 5, 2014, which are hereby incorporated by reference as if fully set forth herein. U.S. patent application Ser. No. 15/287,585 is also a Continuation in Part of U.S. patent application Ser. No. 14/382,756 filed Sep. 3, 2014 and entitled "Digital Printing System", which is a National Phase Entry of PCT Application PCT/IB2013/051717 filed Mar. 5, 2013, which are hereby incorporated by reference as if fully set forth herein. PCT Application PCT/IB2013/051717 gains priority from U.S. Provisional Patent Application 61/640,493 filed Apr. 30, 2012, U.S. Provisional Patent Application 61/635,156 filed Apr. 18, 2012, U.S. Provisional Patent Application 61/619,546 filed Apr. 3, 2012, U.S. Provisional Patent Application 61/619,016 filed Apr. 2, 2012, U.S. Provisional Patent Application 61/611,286 filed Mar. 15, 2012, and U.S. Provisional Patent Application 61/606,913 filed Mar. 5, 2012, all of which are hereby incorporated by reference as if fully set forth herein.

FIELD OF THE INVENTION

The present invention relates to digital printing systems, and in particular to indirect printing systems having a belt serving as an intermediate transfer member.

BACKGROUND

Digital printing techniques have been developed that allow a printer to receive instructions directly from a computer without the need to prepare printing plates. Amongst these are color laser printers that use the xerographic process. Color laser printers using dry toners are suitable for certain applications, but they do not produce images of a photographic quality acceptable for publications, such as magazines.

A process that is better suited for short run high quality digital printing is used in the HP-Indigo printer. In this process, an electrostatic image is produced on an electrically charged image bearing cylinder by exposure to laser light. The electrostatic charge attracts oil-based inks to form a color ink image on the image bearing cylinder. The ink image is then transferred by way of a blanket cylinder onto paper or any other substrate.

Inkjet and bubble jet processes are commonly used in home and office printers. In these processes droplets of ink are sprayed onto a final substrate in an image pattern. In general, the resolution of such processes is limited due to wicking by the inks into paper substrates. The substrate is therefore generally selected or tailored to suit the specific characteristics of the particular inkjet printing arrangement being used. Fibrous substrates, such as paper, generally require specific coatings engineered to absorb the liquid ink in a controlled fashion or to prevent its penetration below the surface of the substrate. Using specially coated substrates is, however, a costly option that is unsuitable for certain printing applications, especially for commercial printing. Furthermore, the use of coated substrates creates its own problems in that the surface of the substrate remains wet and additional costly and time consuming steps are needed to dry the ink, so that it is not later smeared as the substrate is being handled, for example stacked or wound into a roll. Furthermore, excessive wetting of the substrate causes cockling and makes printing on both sides of the substrate (also termed perfecting or duplex printing) difficult, if not impossible.

Furthermore, inkjet printing directly onto porous paper, or other fibrous material, results in poor image quality because of variation of the distance between the print head and the surface of the substrate.

Using an indirect or offset printing technique overcomes many problems associated with inkjet printing directly onto the substrate. It allows the distance between the surface of the intermediate image transfer member and the inkjet print head to be maintained constant and reduces wetting of the substrate, as the ink can be dried on the intermediate image member before being applied to the substrate. Consequently, the final image quality on the substrate is less affected by the physical properties of the substrate.

The use of transfer members which receive ink droplets from an ink or bubble jet apparatus to form an ink image and transfer the image to a final substrate have been reported in the patent literature. Various ones of these systems utilize inks having aqueous carriers, non-aqueous carrier liquids or inks that have no carrier liquid at all (solid inks).

The use of aqueous based inks has a number of distinct advantages. Compared to non-aqueous based liquid inks, the carrier liquid is not toxic and there is no problem in dealing with the liquid that is evaporated as the image dries. As compared with solid inks, the amount of material that remains on the printed image can be controlled, allowing for thinner printed images and more vivid colors.

Generally, a substantial proportion or even all of the liquid is evaporated from the image on the intermediate transfer member, before the image is transferred to the final substrate in order to avoid bleeding of the image into the structure of the final substrate. Various methods are described in the literature for removing the liquid, including heating the image and a combination of coagulation of the image particles on the transfer member, followed by removal of the liquid by heating, air knife or other means.

Generally, silicone coated transfer members are preferred, since this facilitates transfer of the dried image to the final substrate. However, silicone is hydrophobic which causes the ink droplets to bead on the transfer member. This makes it more difficult to remove the water in the ink and also results in a small contact area between the droplet and the blanket that renders the ink image unstable during rapid movement.

Surfactants and salts have been used to reduce the surface tension of the droplets of ink so that they do not bead as much. While these do help to alleviate the problem partially, they do not solve it.

SUMMARY OF THE INVENTION

According to the present invention, there is provided a printing system for printing on front and reverse sides of a substrate, comprising a movable intermediate transfer member in the form of a flexible, substantially inextensible, belt guided to follow a closed path, an image forming station for depositing droplets of a liquid ink onto an outer surface of the belt to form an ink image, a drying station for drying the ink image on the belt to leave an ink residue film on the outer surface of the belt, first and second impression stations spaced from one another in the direction of movement of the belt, each impression station comprising an impression cylinder for supporting and transporting the substrate and a pressure cylinder carrying a compressible blanket for urging the belt against the substrate supported on the impression cylinder, and a transport system for transporting the substrate from the first impression station to the second impression station; wherein the pressure cylinder of at least the first impression station is movable between a first position in which the belt is urged towards the impression cylinder to cause the residue film on the outer surface of the belt to be transferred onto the front side of the substrate supported on the impression cylinder, and a second position in which the belt is spaced from the impression cylinder to allow the ink image on the belt to pass through the first impression station and arrive intact at the second impression station for transfer onto the reverse side of the substrate supported on the second impression cylinder.

The printing system of the invention allows different images to be printed consecutively on the same or opposite sides of the substrate. Different images may be printed consecutively on the same side of a substrate for increase the speed of the printing system by using different impression stations to print different color separations. Printing a second image on the same side of the substrate may also be used for the purpose of applying a varnish coating to a first image.

Embodiments of the invention permit the use of a thin belt because the required conformability of the outer surface of the belt to the substrate is predominantly achieved by the thick blanket carried by the pressure cylinders. The thin belt may display some ability to conform to the topography of the surface of the substrate to allow for the roughness of the surface of the substrate and may include layers having some very slight inherent compressibility. For example, the thickness of the compressible layer in the thin belt may be in the range of 100 to 400 μm, being typically around 125 μm, as compared to the thickness of the compressible layer in the blanket which may be in the range of 1 to 6 mm, being typically 2.5 mm.

By "substantially inextensible" it is meant that the belt has sufficient tensile strength in its lengthwise dimension (in the printing direction) to remain dimensionally stable in that direction. Though the printing system herein disclosed may comprise control systems to monitor any such change in the length of the belt, desirably its circumference varies by no more than 2% or no more than 1% or no more than 0.5% during operation of the system.

In each impression station, the compressible blanket on the pressure cylinder may be continuous, but if it does not extend around the entire circumference of the pressure cylinder then it needs to have a circumferential length at least equal to the maximum length of each image to be printed onto a substrate.

In an embodiment of the invention, the compressible blanket surrounds most but not all of the pressure cylinder to leave a gap between its ends, so that when said gap faces the impression cylinder, the pressure cylinder can disengage therefrom.

If the pressure cylinder of the first impression station is continuous, then a lifting mechanism may be provided to lower the pressure cylinder for operation in the first mode and to raise the pressure cylinder for operation in the second mode.

The mechanism may take the form of an eccentric supporting an axle of the pressure cylinder and a motor for rotating the eccentric to raise and lower the pressure cylinder.

The mechanism may alternatively take the form of a linear actuator.

As an alternative, the compressible blanket may extend over less than half of the pressure cylinder. In this case, displacement of the axle of the pressure cylinder is not necessary as operation of the pressure cylinder will automatically switch between the first and the second mode as the pressure cylinder rotates about its axis.

The separation between the impression cylinders may be a whole number multiple of the circumference of the impression cylinder divided by the number of sheets of substrate that can be transported by the impression cylinder at one time but, in some embodiments of the present invention, such a relationship need not apply.

In a printing system designed to print on a sheet substrate, the impression cylinder may have one or more sets of grippers for retaining the leading edge of each substrate sheet. As the substrate transport system has significant inertia, it normally runs at constant speed and cannot be braked or accelerated between sheets. For this reason, the ink images to be printed on the substrate sheets need to positioned along the belt at regular intervals with the spacing between them corresponding to a whole number multiple of the length of the arc between consecutive grippers or the circumference of the impression cylinder if it can only support one substrate sheet at a time. Furthermore, the ink images to be printed on the reverse side of the substrate sheets need to be interleaved with the ink images to be printed on the front side of the substrate sheets and, to maximize the use of the surface of the belt, these images should be located at least approximately midway between the ink images intended for the front side of the substrate.

For correct alignment of the front and rear ink images, it is important to ensure that when a substrate sheet arrives at the second impression station after traveling through the perfecting system, it should be in the correct position to receive an ink image that has followed a substantially straight line between the two impression stations. For this relationship to hold true, the total distance traveled by the trailing edge of the substrate at the first impression station (which becomes the leading edge at the second impression station) should be equal a whole number multiple of the distance on the belt between ink images intended to be printed on the front side of the substrate plus the offset between the images to be printed on the reverse side of the substrate and those to be printed on the front side. This distance is determined by the diameters and relative phasing of the grippers of the various cylinders of the perfecting system.

A digital printing system that is capable of both duplex printing onto substrate sheets and simplex printing at a higher speed is now additionally disclosed.

Some embodiments of the present invention relate to a digital printing system having two independently operable printing towers arranged in series to print on sheets of substrate, each substrate sheet passing sequentially through both printing towers, and a perfecting mechanism provided between the two towers to reverse substrate sheets during their transfer from the first printing tower to the second printing tower, the perfecting mechanism being selectively operable to enable the second tower to print either on the same side of a substrate sheet as the first tower or on the opposite side of the substrate sheet, wherein, when the perfecting system is operative to reverse the substrate sheets during transfer between the two towers, each tower is operative to impress a complete image onto a respective side of the substrate, and when the perfecting system is inoperative, the first printing tower serves to impress at least one selected separation of an image onto each substrate sheet to form a partial image and the second printing tower is operative to impress the remaining separations of the same image onto the same side of the substrate sheet in register with the partial image formed by the first printing tower.

Embodiments of the invention will be described herein that rely on the process taught by PCT application No. PCT/IB2013/051716, which claims priority from U.S. Provisional Patent Application No. 61/606,913, (both of which applications are herein incorporated by reference in their entirety). Relevant parts of the disclosure of these applications are included herein for the convenience of the reader.

In accordance with an aspect of the invention, there is provided a digital printing system having two independently operable printing towers each having an endless intermediate transfer member, an image forming system serving under digital control to direct droplets of a water-based ink onto the intermediate transfer member to form an ink image, a drier for drying the ink image while it is being transported by the intermediate transfer member to form a residue film, and an impression station at which the residue film is impressed onto a sheet substrate, wherein the two printing towers are arranged in series such that each substrate sheet passes sequentially through both printing towers, and wherein a selectively operable perfecting mechanism is provided between the two towers to reverse each substrate sheet during transfer from the first printing tower to the second printing tower, the perfecting mechanism selectively enabling the second tower to print either on the same side of each substrate sheet as the first tower or on the opposite side of each substrate sheet, wherein, when the perfecting system acts to reverse the substrate sheets during transfer between the two towers, each tower is operative to impress a complete image onto a respective side of the substrate, and when the perfecting system is inoperative, the first printing tower serves to impress at least one selected separation of an image onto each substrate sheet to form a partial image and the second printing tower is operative to impress the remaining separations of the same image onto the same side of the substrate sheet in register with the partial image formed by the first printing tower.

When operating in this manner, any tower serving to print only selected separations of an image, for instance separate portions or colors of an image, may include a plurality of print bars of the same color circumferentially spaced from one another along the image transfer surface. The image forming system is positioned in the printing system at a location also referred to as the image forming station, and these two terms may be hereinafter interchanged.

In an embodiment of the invention, each printing tower comprises four sequentially disposed print bars and the colors of the print bars are arranged in different sequences in the two printing towers, the colors of the two inner print bars in each printing tower being matched to the colors of the two outer print bars in the other printing tower.

Such a print bar configuration simplifies the changeover from simplex to duplex operation in that it is only then necessary to swap over the two inner or intermediate print bars of the sets in the two printing towers with each other. If such a changeover is performed using an automated print bar positioning system, the time taken for the changeover is significantly reduced in that the transport system may move each pair in one operation The print bar positioning system may take the form of a movable carriage guided on rails and having lifting arms for engaging the print bars. For a changeover, the carriage may be aligned with the first tower and its lifting arms used to raise the two intermediate print bars as a pair. The removed pair of print bars may then be parked in a rest position to free the arms of the carriage, which may then be used to raise the two intermediate print bars of the second tower and transfer them to the first tower. As a last step, the temporarily parked pair of print bars may be transferred from the rest position to the second tower.

It is possible for a printing system of the invention to operate in a mode in which after a complete image has been formed on one side of the substrate by the first printing tower, the second tower is use to apply a varnish to the printed side of the substrate instead of forming an image on the opposite side. In this case, the perfecting mechanism would not be used to invert the substrate between the two towers.

A digital printing system is disclosed having two independently operable printing towers arranged in series such that a substrate sheet passes sequentially through both printing towers, and in which a perfecting mechanism is provided between the two towers to reverse each substrate sheet during transfer from the first printing tower to the second printing tower, the perfecting mechanism being selectively operable to enable the second tower to print either on the same side of each substrate sheet as the first tower or on the opposite side of each substrate sheet. As well as allowing a duplex mode, the system provides a higher speed simplex mode during which different separations of the same image are printed by the two towers.

BRIEF DESCRIPTION OF THE DRAWINGS

The invention will now be described further, by way of example, with reference to the accompanying drawings, in which.

DETAILED DESCRIPTION OF ILLUSTRATED EMBODIMENTS

Discussion of FIGS. 1 to 4

Relating initially to the embodiment of FIGS. 1 to 4, though the illustrated embodiment can be used in any indirect printing system having similar configuration, it will be described below with reference to a process where liquid inks are deposited as droplets on the outer surface of an endless belt having repelling properties toward the inks being used. The following examples may refer in particular to the transfer of ink films obtained from the drying of liquid inks having an aqueous carrier typically comprising a coloring agent (e.g., pigments or dyes) and a polymeric resin, these inks having been jetted on a repelling hydrophobic surface of the belt, but the invention need not be limited to such particular embodiments.

Figure 1:
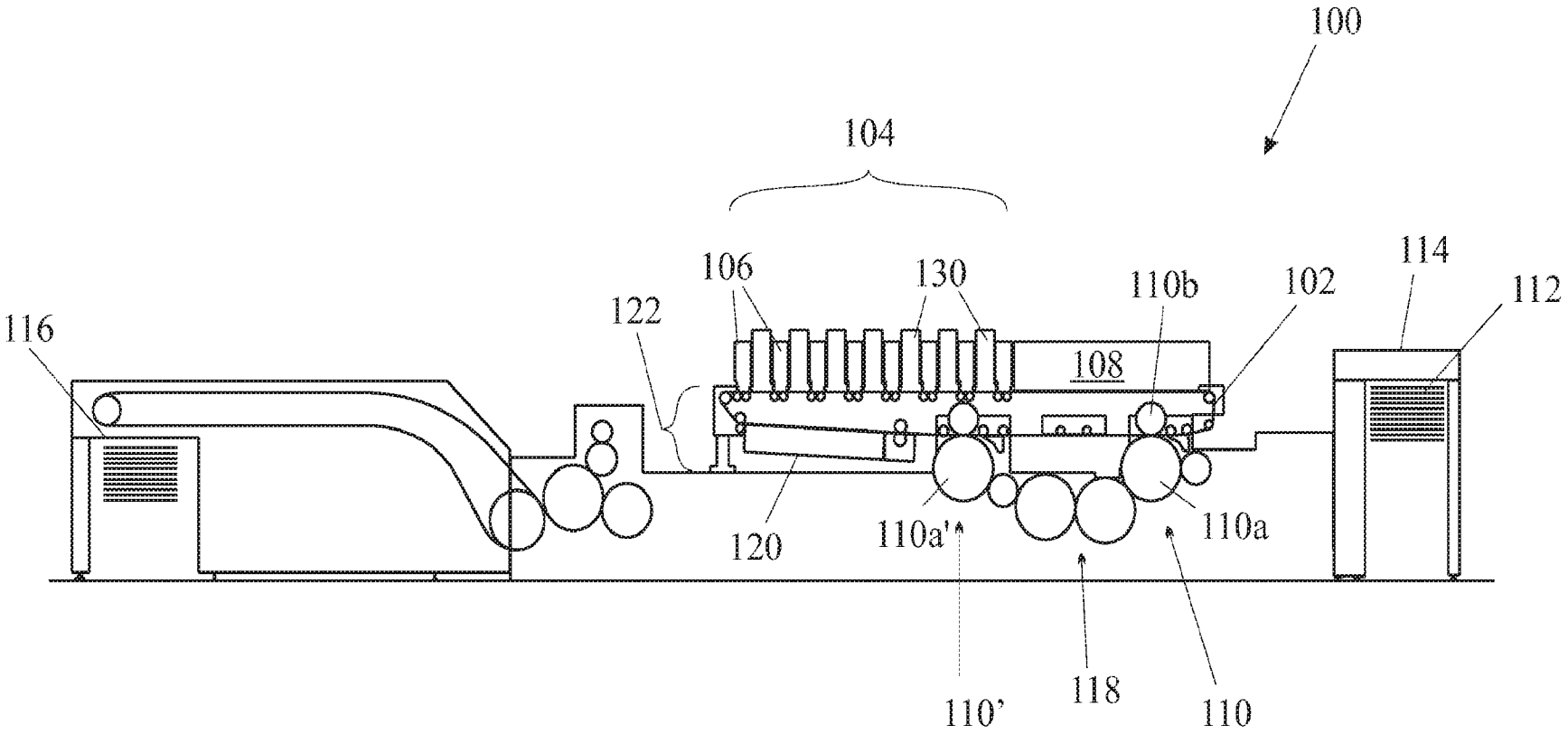
FIG. 1 is a schematic representation of a first embodiment of a printing system according to the present invention.

In FIG. 1, there is shown schematically a printing system 100 having an intermediate transfer member 102 in the form of a belt having a hydrophobic outer surface guided over various rollers of a belt conveyor system 122 to travel in an endless loop. While circulating through the loop, the belt 102 passes through various stations.

At an image forming station 104, print bars 106 deposit droplets of inks onto the hydrophobic outer surface of the belt 102 to form an ink image. The inks of the different bars 106 are usually of different colors and all the inks have particles of resin and coloring agent in an aqueous carrier, apart from some transparent inks or varnishes which may not contain a pigment.

Though the image forming station illustrated in FIG. 1 comprises eight print bars 106, an image forming station may comprise fewer or more print bars. For instance, an image forming system may have three print bars each jetting Cyan (C), Magenta (M) or Yellow (Y) inks, or four print bars with the addition of a Black ink (K).

Within the image forming station 104, a gas (e.g., air) is blown onto the surface of the belt 102 in between print bars 106 by means of head units 130. This is to stabilize the ink droplets to help in fixing them to the belt 102 and to prevent bleeding.

The belt 102 then passes through a drying station 108 where the ink droplets are dried and rendered tacky before they reach impression stations 110, 110' where the ink droplets are transferred onto sheets 112 of substrate. Each impression station 110 includes an impression cylinder 110*a*, 110*a*' and a pressure cylinder 110*b*, 110*b*' which have between them a nip within which the belt 102 is pressed against a substrate. In the illustrated embodiment, the substrate is formed as sheets 112 that are transferred from an input stack 114 to an output stack 116 by a substrate transport system 118. The substrate transport system 118 comprises a perfecting system to allow double-sided, or duplex, printing, which will be described below in more detail. Two impression stations 110, 110' are provided to enable printing on both sides of the substrate, or twice onto the same side, one impression station being positioned upstream and the other downstream of the transport system 118.

It should be mentioned, that by way of example there are only two impression stations in the teachings herein however, anyone skilled in the field of digital printing may appreciate that the invention may comprise two or more impression stations. For example, a printing system with four impression stations may be utilized in order to facilitate a higher rate of printing. The use of more than two impression stations may facilitate printing of specialized inks in addition to the traditional pigment-based inks.

It should be mentioned that the invention is equally applicable to printing systems designed to print on a substrate in the form of a continuous web instead of individual sheets. In such cases, the substrate transport system is accordingly adapted to convey the substrate from an input roller to a delivery roller.

After passing through the impression stations 110, 110' the belt 102 in FIG. 1 passes through an optional cleaning and/or conditioning station 120 before returning to the image forming station 104. The purpose of the station 120 is to remove any ink that may still be adhering to the belt 102 and/or to apply a conditioning agent, to assist in fixing the ink droplets to the outer surface of the belt 102. For belts having certain silicone based outer surfaces, the conditioning agent may be polyethylenimine (PEI). The outer surface of the belt 102 is made hydrophobic to assist in a clean transfer of the tacky ink image to the substrate at the impression station(s) 110. The conditioning station 120 may also act to cool the belt 102 before it returns to the image forming station 104.

The belt 102 in some embodiments of the invention is a thin belt having an inextensible base layer with a hydrophobic release layer on its outer surface. The base layer may suitably comprise a woven fabric that is stretched and laterally tensioned and guided by means of formations on its lateral edges which engage in guide channels. The lateral tension applied by the guide channels in which the side formations of the belt may engage need only be sufficient to maintain the belt 102 flat as it passes beneath the print bars 106 of the image forming station 104. The thin belt 102 may further comprise a conformational layer with a thickness of 100 to 400 microns, but the ability to conform to the topography of the surface of a substrate may alternatively or additionally be provided by the composition of the release layer itself. The pressure cylinder 110*b*, 110*b*' in each of the impression stations 110, 110' carries a thick compressible blanket (not shown) that may typically have a thickness between 1 and 6 mm, typically 2.5 mm, that may be mounted on the cylinder in the same manner as the blanket of an offset litho press or may be a continuous blanket wrapped around or bonded to the entire circumference of the cylinder. The purpose of the blanket on the pressure cylinder is to provide the required overall conformability of the belt to the substrate, serving as a backing cushion to the belt at the impression station. Each of the thin belt and of the compressible blanket may be formed of several layers to modify any other desired capability, such as the mechanical, frictional, thermal and electrical properties of such multi-layered structures.

A printer has previously been demonstrated that had a thick belt, combining the belt 102 with a blanket but this construction requires the blanket to be replaced whenever the belt is worn despite the fact that the blanket has a greater working life. Separating the blanket from the belt and placing it on the pressure cylinder 110*b* allows the belt 102 to be replaced less expensively.

Another important advantage offered by providing the thin belt 102 that is separate from the compressible blanket is that the mass of the circulating belt is decreased. The reduction in mass reduces the amount of power needed to drive the belt 102 thereby improving the energy efficiency of the printing system. The thin belt being devoid of a compressible layer and substantially lacking compressibility is therefore also referred to as a light belt.

The use of a light belt 102 also results in the intermediate transfer member having a lower thermal inertia, which term represents the product of its mass and its specific heat. As it travels through the various stations, the belt 102 is heated and cooled. In particular, the belt 102 is heated as its travels through the heaters of the drying station 108 and through two further optional heaters 210 positioned immediately preceding the impression stations 110 to render the ink film tacky. The temperature of the belt cannot however be high on entering the image forming station 104 because it could cause the ink droplets to boil on impact. Thus, a function of the treatment station 120 can be to cool the belt 102 before it reaches the image forming station 104. The reduction in its thermal inertia considerably reduces the energy consumption of the printing system as less heat energy is stored in the belt 102 when the ink images are being heated and therefore less energy needs to be removed, and wasted, by the treatment station 120.

Figure 2:
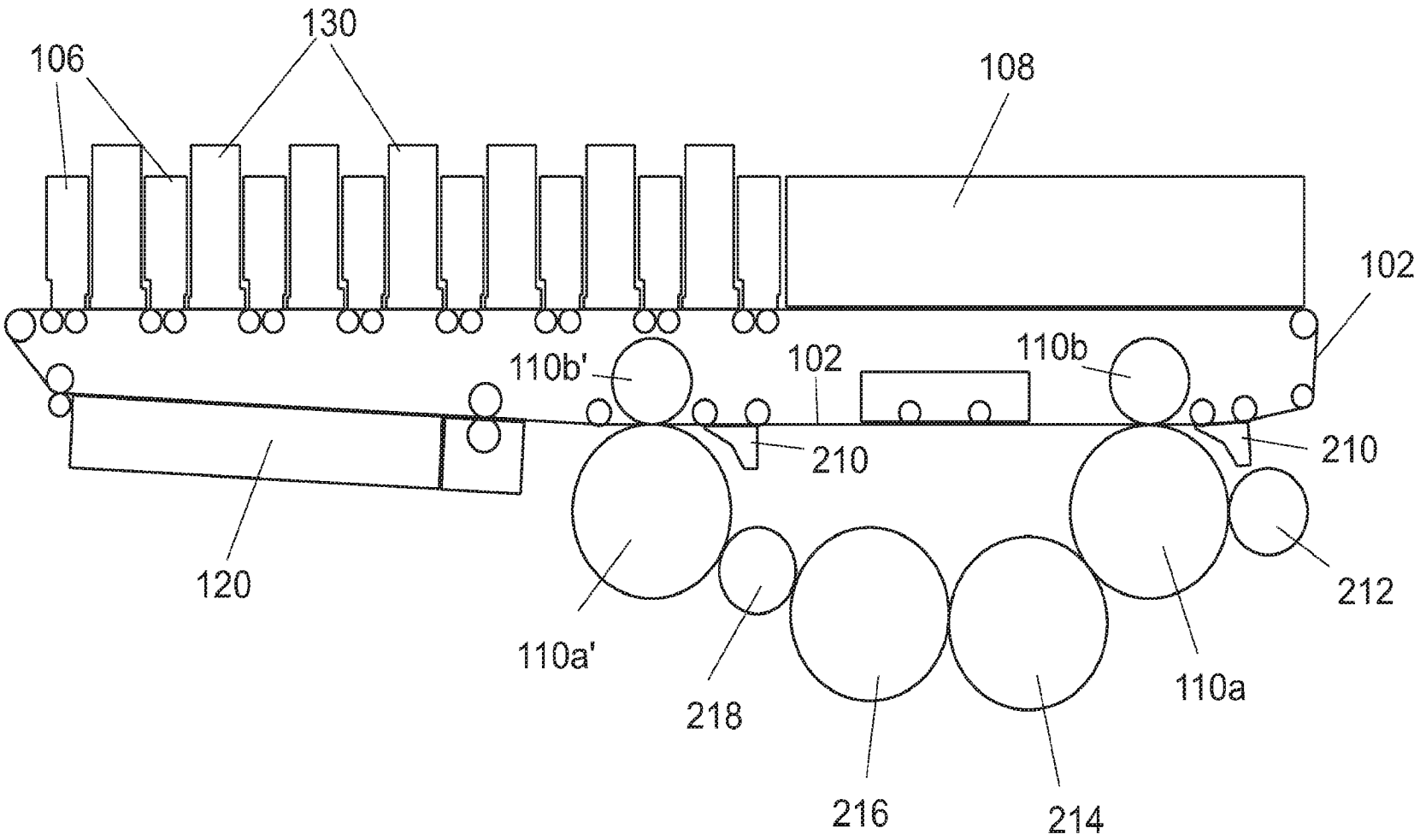
FIG. 2 is a view to an enlarged scale of part of the printing system of FIG. 1.

The substrate transport system in FIG. 2 comprises a feed cylinder 212 that feeds substrate sheets 112 from the stack 114 (not shown, but previously illustrated in FIG. 1) to the impression cylinder 110*a* of the first impression station, at which an image is printed on the front side of each sheet 112. Two transport cylinders 214 and 216 have grippers that hold each sheet by its leading edge and advance each sheet in the manner shown in FIGS. 3 and 4 past a perfecting cylinder 218. When the leading edge of a sheet 112 on the transport cylinder 216 reaches the position shown in FIG. 3, its trailing edge separates from the transport cylinder 216 and is caught by grippers on the perfecting cylinder 218. What was until this point the leading edge of the sheet 112 is then released by the grippers on the transport cylinder 216 and the sheet is offered, reverse side up, to the grippers of the impression cylinder 110*a*' of the second impression station. As well as turning each substrate sheet over, the perfecting cylinder 218 also inverts the page orientation and this must be taken into account in the manner in which the ink images are formed on the belt 102. Though the afore mentioned cylinders may each have more than one sets of grippers that could hold more than one sheet of substrate on their respective circumference, for clarity a single set of grippers is schematically illustrated as 314 and 314' in impression cylinders 110*a* and 110*a'*.

In order for the grippers at the downstream impression station to coincide with the trailing edge of the perfected substrate, the relative phase of the two impression cylinders can be adjusted as a function of the length of the substrate.

In order for an ink image to arrive at the second impression station 110', it must be capable of passing intact through the first impression station 110. For this reason, at least the first impression station 110 must switch between two modes of operation. In the first, the belt 102 is pressed against the substrate and image transfer takes place and in the second mode a gap remains between belt and the first impression cylinder so that the ink image intended for the second impression station may pass unscathed.

In some embodiments, switching between operating modes is effected by raising the axle of the pressure cylinder 110*b*. This may be carried out by using two eccentrics (one at each end) to supporting the axle of the pressure cylinder and a motor for rotating the eccentrics to raise and the lower the pressure cylinder. Alternatively, the axle may be journalled in slide blocks that are moved by a linear actuator. Such an approach may be used when the compressible blanket on the pressure cylinder encompasses the whole, or the majority, of the circumference of the pressure cylinder 110*b*.

In an alternative embodiment, the pressure cylinder 110*b* is made with a larger diameter and the blanket overlies less than half of the circumference. In this case, the axis of the pressure cylinder may remain stationary as engagement between the pressure cylinder 110*b* and the impression cylinder 110*a* will only occur at times when the blanket on the pressure cylinder faces the impression cylinder and in any cycle of the pressure cylinder, the impression stage will alternate between the first and second modes of operation.

Figure 3:
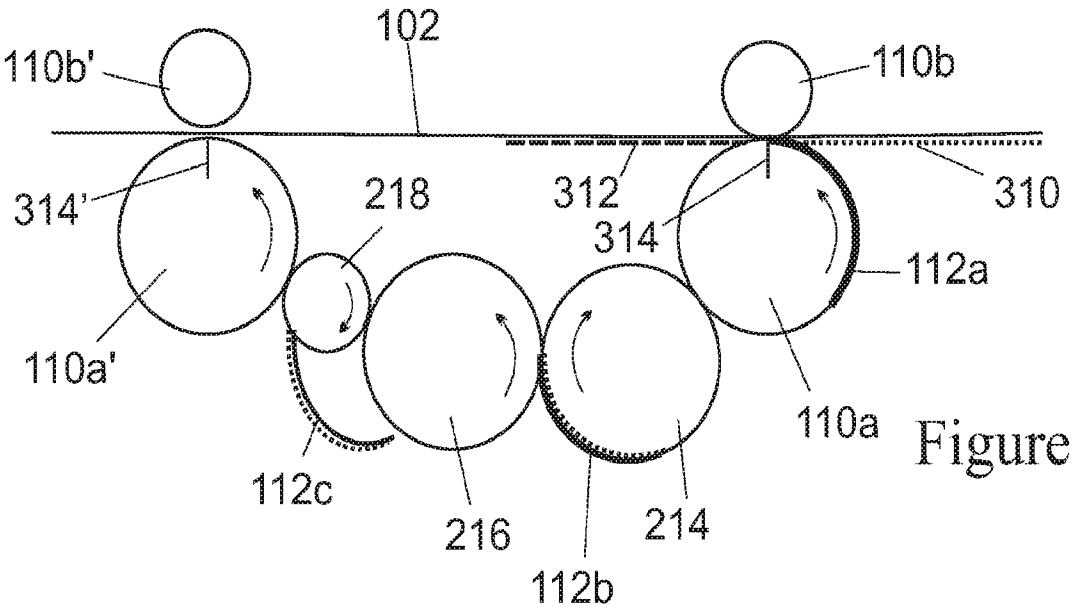
FIGS. 3 and 4 are schematic representations of the two impression stations in FIG. 2 at different times during the operating cycle.
Figure 4:
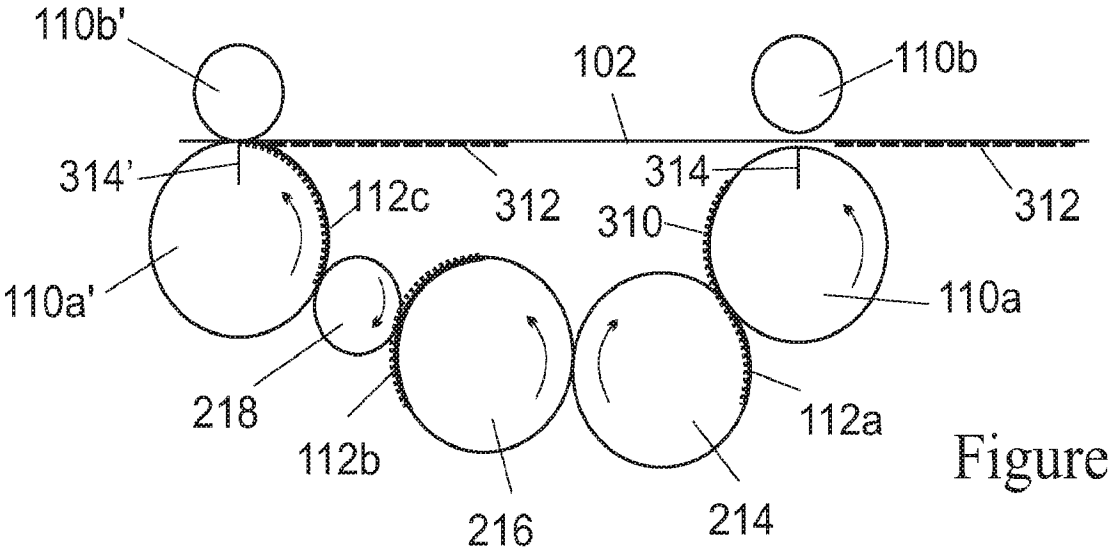

In FIGS. 3 and 4, ink images to be printed on the front side of the substrate are represented by dots and those to be printed on the reverse side a represented by dashes. FIG. 3 shows the instant at which the nip between the pressure cylinder 110*b* and the impression cylinder 110*a* of the first impression station has just been closed. A substrate sheet 112*a* on the impression cylinder is ready to receive the image 310, represented by dots, and an image 312, represented by dashes, has passed intact through the impression station while the nip was still open. At the same time, a sheet 112*b* is supported front face down on the transport cylinder 214 and a further sheet 112*c* is in the process of being transferred from the transport cylinder 216 to the perfecting cylinder 218, the sheet 112*c* being shown at the point where its trailing edge has been captured by the perfecting cylinder 218 and its leading edge released by the grippers of the transport cylinder 216.

Continued rotation of the various cylinders in the direction of the illustrated arrows results in the condition shown in FIG. 4. Here, the nip of the first impression station has been opened to allow a new image 312 to pass through. The sheet 112*a* has been transported, front side up, to the transport cylinder 214 and transferred onto the latter cylinder. The sheet 112*b* has in the meantime been transferred to the transport cylinder 216 and the sheet 112*c* that was inverted by the perfecting cylinder 218 is now supported by the second impression cylinder 110*a*' ready to pass through the closed nip of the second impression station to receive the image 312 onto its reverse side.

FIG. 3 shows the second impression station with its nip open and this avoids the surface of the belt being pressed against the impression cylinder 110*a*' when no substrate sheet is present. While this is preferable to avoid wear of the belt and possible dirtying of the impression cylinder if any ink remains on the belt, it is not essential.

The spacing between the two impression stations is not critical to correct alignment of the images on the front and reserve sides of the substrate. The length of the path of the substrate sheets through the transport system needs only to match the spacing between the front and reverse ink images on the belt 102 and this can be achieved by correct dimensioning of the diameters of the various cylinders 214, 216 and 218 and the relative phasing of their grippers.

While the invention has been described above by reference to printing on substrate sheets, it will be clear to the person skilled in the art that the invention is equally applicable to a printing system that prints on a continuous web. In this case, a web reversing mechanism may be used in place of the perfecting cylinder and once again the length of the web between the two impression stations needs to adjust, for example by the use of idler rollers, to correspond to the spacing of the front and reverse ink images on the belt.

Discussion of FIGS. 5 to 8

FIGS. 5 to 8 show a printing system as described in PCT Application No. PCT/IB2013/051716 and are similar to FIGS. 1 to 4 in the latter application. Their description is reproduced below to provide a detailed understanding of the process of indirect inkjet printing using water-based inks. FIGS. 5 to 8 are not, however, in accordance with embodiments of the invention, but differ from it in that they show a single intermediate transfer member having two spaced impression stations. By contrast, in embodiments of the invention, as will be described below by reference to FIGS. 9 to 11, each impression station forms part of a separate printing tower that includes its own intermediate transfer member and its own image forming system.

Essentially the printing system illustrated in FIGS. 5 to 8 comprises three separate and mutually interacting systems, namely a blanket system 1100, an image forming system 1300 above the blanket system 1100 and a substrate transport system 1500 below the blanket system 1100.

The blanket system 1100 comprises an endless belt or blanket 1102 that acts as an intermediate transfer member and is guided over two rollers 1104, 1106. As will be described with reference to FIGS. 9 and 10, it is alternatively possible to use a rigid drum to support the blanket. An image made up of dots of an ink is applied by the image forming system 1300 to an upper run of the blanket 1102. A lower run selectively interacts at two impression stations with two impression cylinders 1502 and 1504 of the substrate transport system 1500 to impress an image onto a substrate compressed between the blanket 1102 and the respective impression cylinder 1502, 1504 by the action of respective pressure rollers 1140, 1142. The purpose of there being two impression cylinders 1502, 1504 in the illustrated printing system is to permit duplex printing using a single intermediate transfer member. It should be noted by contrast that in the present invention only one impression station is present per transfer member.

In operation, ink images, each of which is a mirror image of an image to be impressed on a final substrate, are printed by the image forming system 1300 onto the upper run of blanket 1102. In this context, the term "run" refers to a length or segment of the blanket between any two given rollers over which the blanket is guided. While being transported by the blanket 1102, the ink is heated to dry it by evaporation of most, if not all, of its liquid carrier. The ink image is furthermore heated to render tacky the film of ink solids remaining after evaporation of the liquid carrier, this film being referred to as a residue film, to distinguish it from the thicker liquid film formed by flattening of each ink droplet upon impact with the transfer member. At the impression cylinders 1502, 1504 the image is impressed onto individual sheets 1501 of a substrate which are conveyed by substrate transport system 1500 from an input stack 1506 to an output stack 1508 via the impression cylinders 1502, 1504. The residue film is rendered tacky typically when a polymeric resin of a suitable ink composition is softened so as to increase the subsequent ability of the film to adhere to the substrate as compared to its ability to adhere to the transfer member.

Image Forming System

In an embodiment of the invention, the image forming system 1300 comprises print bars 1302 each slidably mounted on a frame 1304 positioned at a fixed height above the surface of the blanket 1102. Each print bar 1302 may comprise a strip of print heads as wide as the printing area on the blanket 1102 and comprises individually controllable print nozzles. The image forming system can have any number of bars 1302, each of which may contain an ink of a different color.

As some print bars may not be required during a particular printing job, the heads can be moved between an operative position, in which they overlie the blanket 1102 and an inoperative position. A mechanism is provided for moving print bars 1302 between their operative and inoperative positions, but the mechanism is not illustrated and need not be described herein as it is not relevant to the printing process. It should be noted that the bars preferably remain stationary during printing.

When moved to their inoperative position, the print bars can be covered for protection and to prevent the nozzles of the print bar from drying or clogging. In an embodiment of the invention, the print bars are parked above a liquid bath (not shown) that assists in this task. Print bars that are in the inoperative position can be changed and accessed readily for maintenance, even while a printing job is in progress using other print bars.

Within each print bar, the ink may be constantly recirculated, filtered, degassed and maintained at a desired temperature and pressure. As the design of the print bars may be conventional, or at least similar to print bars used in other inkjet printing applications, their construction and operation will be clear to the person skilled in the art without the need for more detailed description.

As different print bars 1302 are spaced from one another along the length of the blanket, it is of course essential for their operation to be correctly synchronized with the movement of blanket 1102. Further details of suitable control systems for such printing systems are disclosed in PCT Application No. PCT/IB2013/051727.

If desired, it is possible to provide a blower 1306 following each print bar 1302 to blow a slow stream of a hot gas, preferably air, over the intermediate transfer member to commence the drying of the ink droplets deposited by the print bar 1302. This assists in fixing the droplets deposited by each print bar 1302, that is to say resisting their contraction and preventing their movement on the intermediate transfer member, and also in preventing them from merging into droplets deposited subsequently by other print bars 1302.

In one embodiment of the invention, the inks used in the print heads comprise nano-particles of organic polymeric resin and coloring agent (e.g. pigment or dye) suspended or dissolved in an aqueous carrier. The nano-pigments can have an average particle size $D_{50}$ of at least 10 nm and of at most 300 nm, however such range may vary for each ink color and in some embodiments the pigments may have a $D_{50}$ of at most 200 nm or of at most 100 nm. Acrylic polymers and acrylic-styrene co-polymers with an average molecular weight around 60,000 g/mole have been found to be suitable resins. Further details of non-limiting examples of ink compositions suitable for the printing processes and systems of the present invention are disclosed in PCT Application No. PCT/IB2013/051755.

Blanket and Blanket Support System

The blanket 1102, in one embodiment of the invention, is seamed. In particular, the blanket is formed of an initially elongate flat strip of which the ends are releasably or permanently fastened to one another to form a continuous loop. The releasable fastening may be a zip fastener or a hook and loop fastener that lies substantially parallel to the axes of rollers 1104 and 1106 over which the blanket is guided. Permanent fastening may be achieved, for example following installation of the blanket over its rollers, by adhering its opposite ends one to another to form a continuous belt loop by soldering, gluing, taping (e.g. using Kapton® tape, RTV liquid adhesives or PTFE thermoplastic adhesives with a connective strip overlapping both ends of the strip), or any other method commonly known. Any method of joining the ends of the blanket may cause a discontinuity, referred to herein as a seam, and it is desirable to avoid an increase in the thickness or discontinuity of chemical and/or mechanical properties of the belt at the seam. In order to avoid a sudden change in the tension of the blanket as the seam passes over these rollers, it is desirable to incline the fastener relative to the axis of the roller but this enlarges the non-printable image area. In an alternative embodiment, the blanket forms a continuous and seamless loop, the belt having the same properties along its circumference.

The primary purpose of the blanket is to receive an ink image from the image forming system and to transfer that image dried but undisturbed to the impression stations. To allow easy transfer of the ink image at each impression station, the blanket has a thin upper release layer that is hydrophobic. The outer surface of the transfer member upon which an aqueous ink can be applied may comprise a silicone material. A silanol-terminated polydialkylsiloxane material, as well as other silanol-, sylyl- or silane-modified or terminated polydialkylsiloxane curable silicone polymers, and amino silicones have been found to work well, but it is believed that the exact formulation of the silicone is not critical and any material that allows for release of the image from the transfer member to a final substrate is believed to be suitable. Further details of non-limiting examples of release layers and intermediate transfer members are disclosed in PCT Applications No. PCT/IB2013/051743 and No. PCT/IB2013/051751. Suitably, the materials forming the release layer allow it to be not absorbent. Preferably, the material is selected so that the transfer member does not swell (or is not solvated) by the carrier liquid of the ink or of any other fluid that may be applied to the release layer.

The strength of the blanket can be derived from a reinforcement layer. In one embodiment, the reinforcement layer is formed of a fabric. If the fabric is woven, the warp and weft threads of the fabric may have a different composition or physical structure so that the blanket should have, for reasons to be discussed below, greater elasticity in its width ways direction (parallel to the axes of the rollers 1104 and 1106) than in its lengthways direction, in which it is preferably substantially non-extendible. In one embodiment, the fibers of the reinforcement layer in the longitudinal direction are substantially aligned with the printing direction and are made of high performance fibers (e.g. aramid, carbon, ceramic, glass fibers etc.)

The blanket may comprise additional layers between the reinforcement layer and the release layer, for example to provide conformability and compressibility of the release layer to the surface of the substrate, to act as a thermal reservoir or a thermal partial barrier and/or to allow an electrostatic charge to the applied to the release layer. An inner layer may further be provided to control the frictional drag on the blanket as it is rotated over its support structure. Other layers may be included to adhere or connect the afore-mentioned layers one with another or to prevent migration of molecules therebetween.

Figure 7:
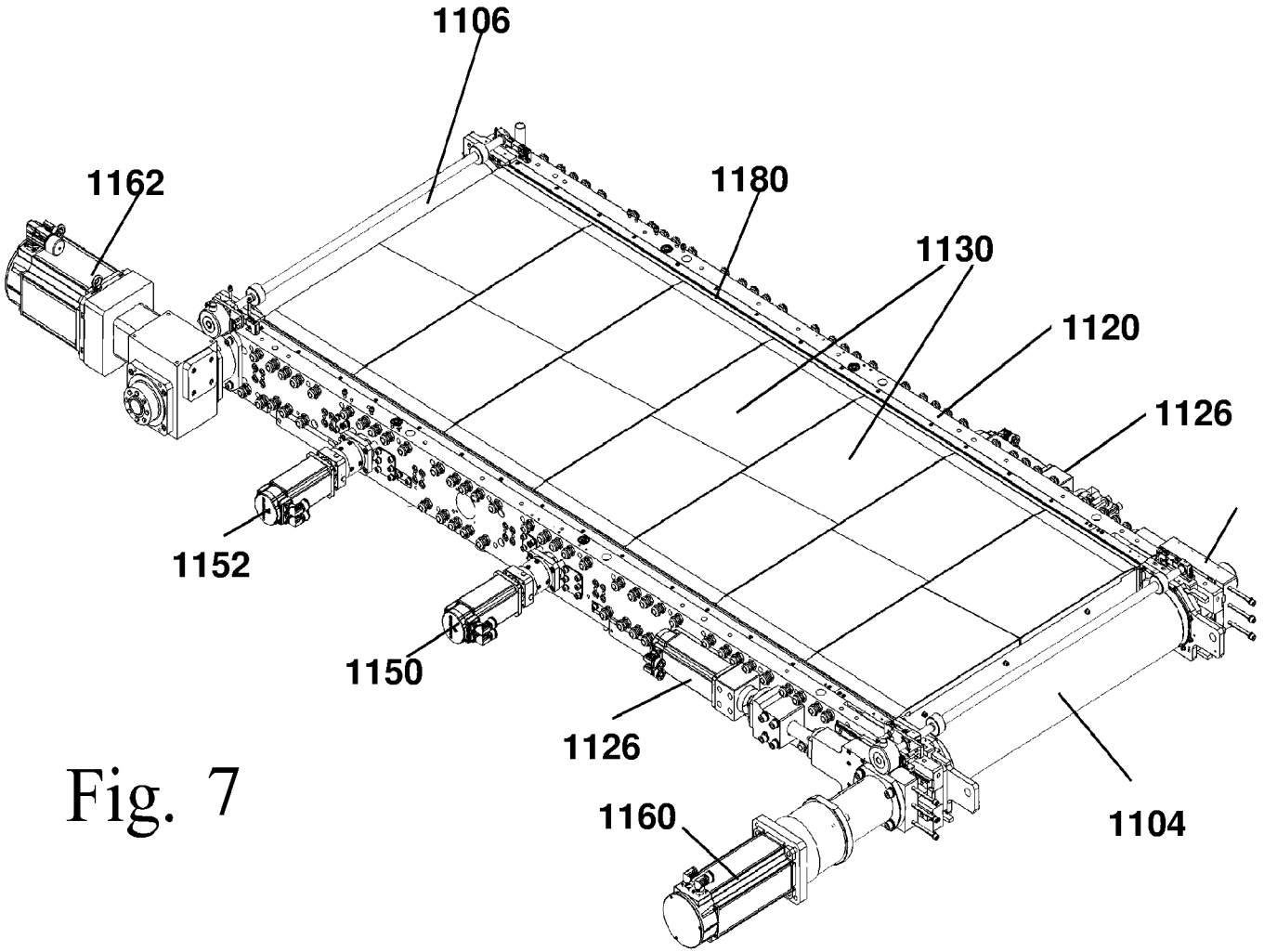
FIG. 7 is a perspective view of a blanket support system of FIGS. 5 and 6 with the blanket removed.
Figure 8:
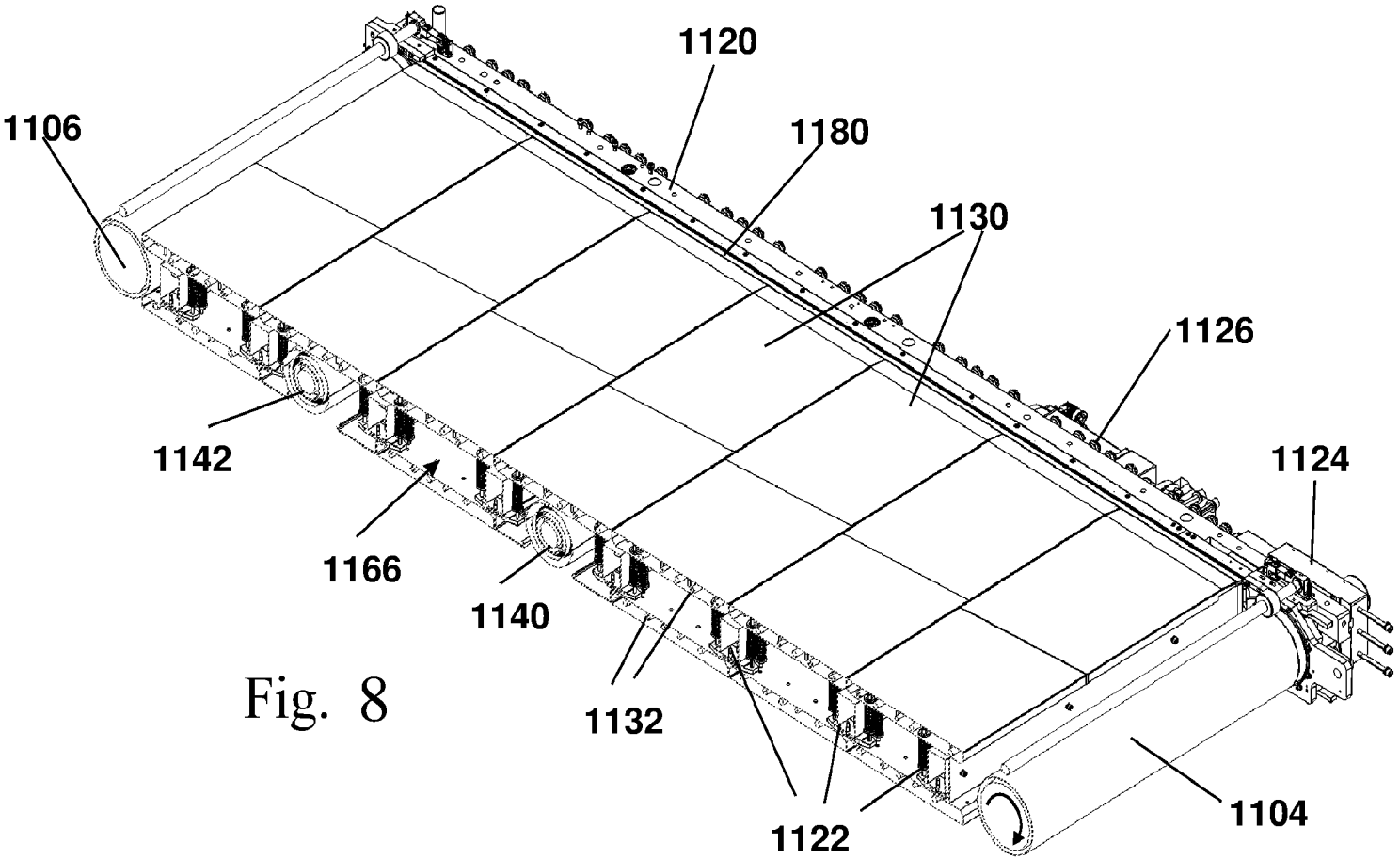
FIG. 8 shows a section through the blanket support system of FIG. 7 showing its internal construction.

The structure supporting the blanket is shown in FIGS. 7 and 8. Two elongate outriggers 1120 are interconnected by a plurality of cross beams 1122 to form a horizontal ladder-like frame on which the remaining components are mounted.

The roller 1106 is journalled in bearings that are directly mounted on outriggers 1120. At the opposite end, however, the roller 1104 is journalled in pillow blocks 1124 that are guided for sliding movement relative to outriggers 1120. Motors 1126, for example electric motors, which may be stepper motors, act through suitable gearboxes to move pillow blocks 1124, so as to alter the distance between the axes of rollers 1104 and 1106, while maintaining them parallel to one another.

Thermally conductive support plates 1130 are mounted on cross beams 1122 to form a continuous flat support surface both on the top side bottom sides of the support frame. The junctions between the individual support plates 1130 are intentionally offset from each other (e.g., zigzagged) in order not to create a line running parallel to the length of the blanket 1102. Electrical heating elements 1132 are inserted into transverse holes in the plates 1130 to apply heat to the plates 1130 and through the plates 1130 to the blanket 1102. Other means for heating the blanket will occur to the person of skill in the art and may include heating from below, above of within the blanket itself.

Also mounted on the blanket support frame are two pressure or nip rollers 1140, 1142. The pressure rollers are located on the underside of the support frame in gaps between the support plates 1130 covering the underside of the frame. Pressure rollers 1140, 1142 are aligned respectively with impression cylinders 1502, 1504 of the substrate transport system. Each impression cylinder and corresponding pressure roller, when engaged as described below, form an impression station.

Each of the pressure rollers 1140, 1142 is mounted so that it can be raised and lowered from the lower run of the blanket. In one embodiment each pressure roller is mounted on an eccentric that is rotatable by a respective actuator 1150, 1152. When it is raised by its actuator to an upper position within the support frame, each pressure roller is spaced from the opposing impression cylinder, allowing the blanket to pass by the impression cylinder without making contact with neither the impression cylinder itself nor with a substrate carried by the impression cylinder. On the other hand, when moved downwards by its actuator, each pressure roller 1140, 1142 projects downwards beyond the plane of the adjacent support plates 1130 and deflects the blanket 1102, forcing it against the opposing impression cylinder 1502, 1504. In this lower position, it presses the lower run of the blanket against a final substrate being carried on the impression roller.

In embodiments of the present invention, it is optional for a pressure or nip roller to be disengageable from its impression cylinder. In embodiments using a seamed blanket, it is either possible to use a disengageable nip roller to assist in allowing the seam to pass between the nip roller and the impression cylinder, or one may rely solely on the passage of the seam being timed to coincide with an optional recess in the surface of the impression cylinder that can for instance be used to accommodate grippers for holding the substrate sheets in position on the impression cylinder. In an alternative embodiment, the blanket may be seamless and the impression cylinder continuous, for instance when printing on a web substrate. The rollers 1104 and 1106 are connected to respective electric motors 1160, 1162. The motor 1160 is the more powerful and serves to drive the blanket clockwise as viewed in FIGS. 7 and 8. The motor 1162 provides a torque reaction and can be used to regulate the tension in the upper run of the blanket. The motors 1160, 1162 may operate at the same speed in an embodiment in which the same tension is maintained in the upper and lower runs of the blanket.

Alternatively, the motors 1160 and 1162 may be operated in such a manner as to maintain a higher tension in the upper run of the blanket where the ink image is formed and a lower tension in the lower run of the blanket. The lower tension in the lower run may assist in absorbing sudden perturbations caused by the abrupt engagement and disengagement of blanket 1102 with impression cylinders 1502 and 1504.

In an embodiment of the invention, a fan or air blower (not shown) is mounted on the frame to maintain a sub-atmospheric pressure in the volume 1166 bounded by the blanket and its support frame. The negative pressure serves to maintain the blanket flat against the support plates 1130 on both the upper and the lower side of the frame, in order to achieve good thermal contact. If the lower run of the blanket is set to be relatively slack, the negative pressure would also assist in maintaining the blanket out of contact with the impression cylinders when the pressure rollers 1140, 1142 are not actuated.

In an embodiment of the invention, each of the outriggers 1120 also supports a continuous track 1180, which engages formations on the side edges of the blanket to maintain the blanket taut in its width ways direction. The formations may be spaced projections, such as the teeth of one half of a zip fastener sewn or otherwise attached to the side edge of the blanket. Alternatively, the formations may be a continuous flexible bead of greater thickness than the blanket. The lateral track guide channel may have any cross-section suitable to receive and retain the blanket lateral formations and maintain it taut. To reduce friction, the guide channel may have rolling bearing elements to retain the projections or the beads within the channel.

To mount a blanket on its support frame, according to one embodiment of the invention, entry points are provided along tracks 1180. One end of the blanket is stretched laterally and the formations on its edges are inserted into tracks 1180 through the entry points. Using a suitable implement that engages the formations on the edges of the blanket, the blanket is advanced along tracks 1180 until it encircles the support frame. The ends of the blanket are then fastened to one another to form an endless loop. The rollers 1104 and 1106 can then be moved apart to tension the blanket and stretch it to the desired length. Sections of tracks 1180 are telescopically collapsible to permit the length of the track to vary as the distance between rollers 1104 and 1106 is varied. Further details on non limiting exemplary formations, corresponding tracks and methods of mounting a blanket are disclosed in PCT Application No. PCT/IB2013/051719.

In order for the image to be properly formed on the blanket and transferred to the final substrate, a number of different elements of the system must be properly synchronized. In order to position the images properly on the blanket, the position and speed of the blanket must be both known and controlled. In an embodiment of the invention, the blanket is marked at or near its edge with one or more markings spaced in the direction of motion of the blanket. The marking(s) may for example be applied to the surface of the blanket that may be sensed magnetically or optically by a suitable detector. Alternatively, a marking may take the form of an irregularity in the lateral projections that are used to tension the blanket, for example a missing tooth, hence serving as a mechanical position indicator. One or more sensors (not shown) senses the timing of these markings as they pass the sensor. The speed of the blanket and the speed of the surface of the impression rollers should be the same, for proper transfer of the images to the substrate from the transfer blanket. Signals from the sensor 1107 are sent to a controller 1109 which also receives an indication of the speed of rotation and angular position of the impression rollers, for example from encoders on the axis of one or both of the impression rollers (not shown). The sensor 1107, or another sensor (not shown), also determines the time at which the seam of the blanket passes the sensor. For maximum utility of the usable length of the blanket, it is desirable that the images on the blanket start as close to the seam as feasible.

The controller controls the electric motors 1160 and 1162 to ensure that linear speed of the blanket is the same as the speed of the surface of the impression rollers.

Because the blanket contains an unusable area resulting from the seam, it is important to ensure that this area always remain in the same position relative to the printed images in consecutive cycles of the blanket. Also, it is preferable to ensure that whenever the seam passes the impression cylinder, it should always coincides with a time when the recess in the surface of the impression cylinder that accommodates the substrate grippers faces the blanket.

Preferably, the length of the blanket is set to be a whole number multiple of the circumference of the impression cylinders 1502, 1504. In embodiments wherein the impression cylinder may accommodate two sheets of substrate, the length of the blanket may be a whole multiple of half the circumference of an impression cylinder. Since the length of the blanket may change with time and/or temperature, the position of the seam relative to the impression rollers is preferably changed, by momentarily changing the speed of the blanket. When synchronism is again achieved, the speed of the blanket is again adjusted to match that of the impression rollers, when it is not engaged with the impression cylinders 1502, 1504. The length of the blanket can be determined from a shaft encoder measuring the rotation of one of rollers 1104, 1106 during one sensed complete revolution of the blanket.

The controller also controls the timing of the flow of data to the print bars and may control proper timing of any optional sub-system of the printing system, as known to persons skilled in the art of printing.

This control of speed, position and data flow ensures synchronization between image forming system 1300, substrate transport system 1500 and blanket system 1100 and ensures that the images are formed at the correct position on the blanket for proper positioning on the final substrate.

As its length is a factor in synchronization, the blanket is required to resist stretching and creep. In the transverse direction, on the other hand, it is only required to maintain the blanket flat taut without creating excessive drag due to friction with the support plates 1130. It is for this reason that, in an embodiment of the invention, the elasticity of the blanket is intentionally made anisotropic.

Blanket Pre-treatment

Figure 5:
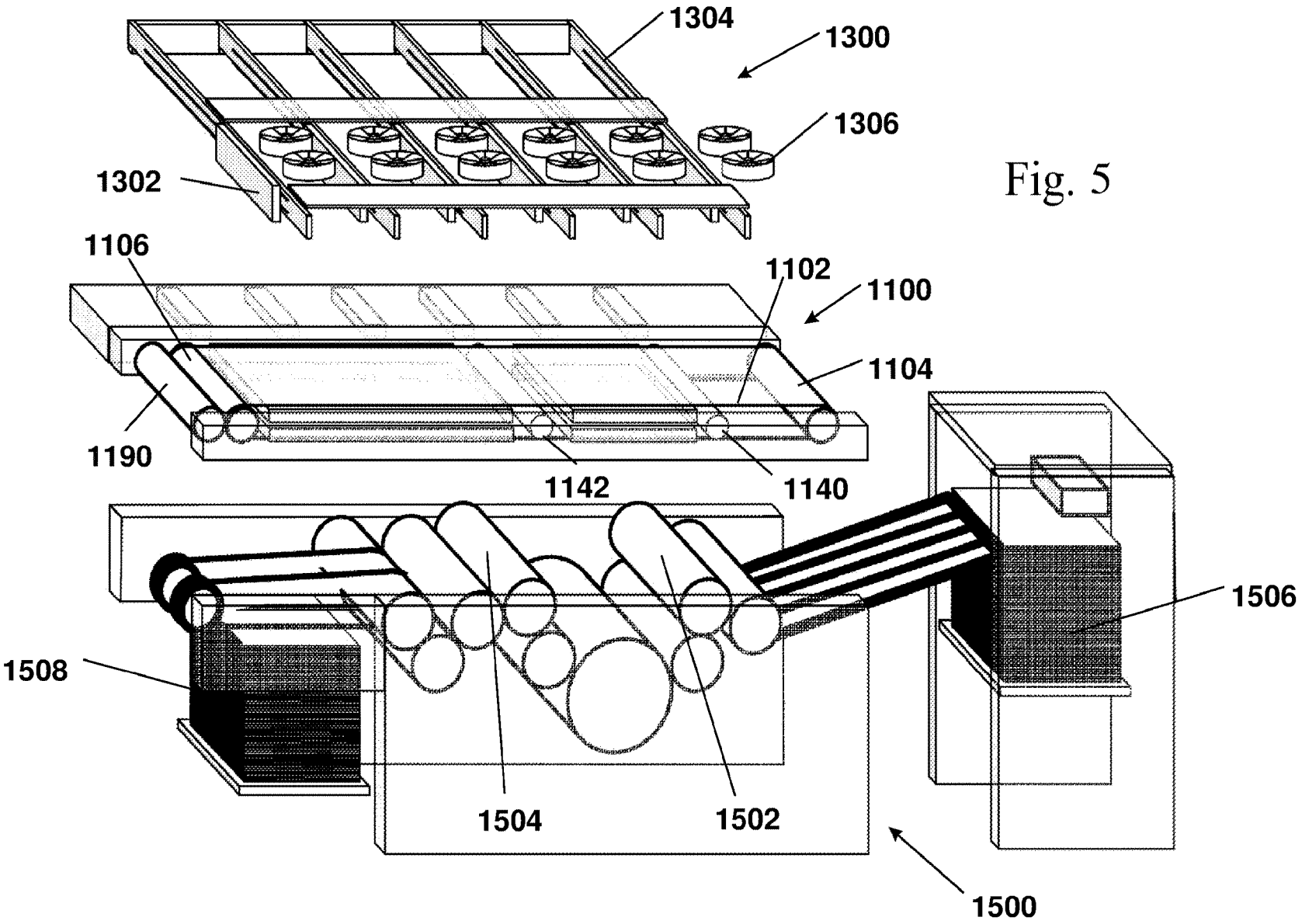
FIG. 5 is an exploded schematic perspective view of a printing system as described in PCT Application No. PCT/IB2013/051716.

FIG. 5 shows schematically a roller 1190 positioned externally to the blanket immediately before the roller 1106, according to an embodiment of the invention. The function of this roller is if required to apply a thin film of pre-treatment solution containing a chemical agent, for example a dilute solution of a charged polymer, to the surface of the blanket. The film is preferably, totally dried by the time it reaches the print bars of the image forming system, to leave behind a very thin layer on the surface of the blanket that assists the ink droplets to retain their film-like shape after they have impacted the surface of the blanket.

While a roller can be used to apply an even film, in an alternative embodiment the elective pre-treatment material is sprayed onto the surface of the blanket and spread more evenly, for example by the application of a jet from an air knife, a drizzle from sprinkles or undulations from a fountain. The pre-treatment solution may be removed from the transfer member shortly following its exposure therewith (e.g. using air flow).

The average thickness of the elective pre-treatment solution may vary between initial application, optional removal and dried stage and is typically below 1000 nanometers, below 800 nm, below 600 nm, below 400 nm, below 200 nm, below 100 nm, below 50 nm, below 20 nanometers, below 10 nanometers, below 5 nanometers, or below 2 nanometers.

The purpose of the optionally applied chemical agent is to counteract the effect of the surface tension of the aqueous ink upon contact with the hydrophobic release layer of the blanket. It is believed that such pre-treatment chemical agents, for instance some charged or chargeable polymers comprising amine nitrogen atoms in a plurality of functional groups each independently selected from linear, branched and cyclic, primary amines, secondary amines, tertiary amines, and quaternized ammonium groups and having a relatively high charge density and molecular weight (e.g. at least 10,000 g/mole), will bond (temporarily at least), with the silicone surface of the transfer member to form a positively charged layer. Suitable conditioning agents include linear and branched polyethylene imine (PEI), modified polyethylene imine, guar hydroxylpropyltrimonium chloride, hydroxypropyl guar hydroxyl-propyl-trimonium chloride, vinyl pyrrolidone dimethylaminopropyl methacrylamide copolymer, vinyl caprolactam dimethylaminopropyl methacrylamide hydroxyethyl methacrylate, quaternized vinyl pyrrolidone dimethylaminoethyl methacrylate copolymer, poly(diallyldimethyl-ammonium chloride), poly(4-vinylpyridine) and polyallylamine.

However, the amount of charge that is present in such layer is believed to be much smaller than that in the droplet itself. The present inventors have found that a very thin layer, perhaps even a layer of molecular thickness will be adequate. This layer of pre-treatment of the transfer member, if required, may be applied in very dilute form of the suitable chemical agents. Ultimately this thin layer may be transferred onto the substrate, along with the image being impressed. Further details on exemplary pretreatment solutions are disclosed in PCT Application No. PCT/IB2013/000757.

When the droplet impinges on the transfer member, the momentum in the droplet causes it to spread into a relatively flat volume. In the prior art, this flattening of the droplet is almost immediately counteracted by the combination of surface tension of the aqueous droplet and the hydrophobic nature of the surface of the transfer member.

The shape of the ink droplet is preferably "frozen" such that at least some and preferably a major part of the flattening and horizontal extension of the droplet present on impact is preserved. It should be understood that since the recovery of the droplet shape after impact is very fast, the methods of the prior art would not effect phase change by agglomeration and/or coagulation and/or migration.

Without wishing to be bound by theory, it is believed that, on impact, van der Waals forces acting between the molecules of the polymer and/or pigment particles in the ink and molecules residing on the surface of the hydrophobic release layer (stemming either from the composition of the release layer and/or from the composition of the pretreatment solution) act to resist the beading up of the droplets under the action of surface tension.

The amount of charge on the surface of the intermediate transfer member is too small to adhere more than a small number of particles, so that, it is believed, the concentration and distribution of particles in the drop is not substantially changed. Furthermore, since the ink is aqueous, the effects of the positive charge are very local, especially in the very short time span needed for freezing the shape of the droplets (at most few seconds and generally less than one).

However, it has been surprisingly found that this attraction has a profound effect on the shape of the droplets after they stabilize. It is believed that the attractive force acts to counteract the repelling of the water in the ink by the silicone. The result is that a relatively flat droplet film of ink of greater extent than would be present in the absence of the charge on the silicone surface is formed on the transfer member. Furthermore, since in areas that are not reached by the droplet the effective hydrophobic nature of the transfer member is maintained, there is little or no spreading of the droplet above that achieved in the initial impact and the boundaries of the droplet are distinct.

While applicants have found that coating or spraying the transfer member with a chargeable polymer is an effective method for fixing the droplets, it is believed that otherwise transferring positive charge to the transfer member is also possible, although this is a much more complex process. Other effects that may contribute to the shape of the droplet remaining as a flattened film are quick heating of the droplet that increases its viscosity, a barrier (the polymer coating) that reduces the hydrophobic effect of the silicone coating and a surfactant that reduces the surface tension of the ink.

The residue film may have an average thickness below 1500 nanometers, below 1200 nm, below 1000 nm, below 800 nanometers, below 600 nm, below 500 nm, below 400 nm, below 300 nm, below 200 nm, and of at least 50 nm, at least 100 nm, or at least 150 nm.

Ink Image Heating

The heaters 1132 inserted into the support plates 1130 are used to heat the blanket to a temperature that is appropriate for the rapid evaporation of the ink carrier and compatible with the composition of the blanket. For blankets comprising for instance silanol-, sylyl- or silane-modified or terminated polydialkylsiloxane silicones in the release layer, heating is typically of the order of 150° C., though this temperature may vary within a range from 120° C. to 180° C., depending on various factors such as the composition of the inks and/or of the pre-treatment solutions if needed. Blankets comprising amino silicones may generally be heated to temperatures between 70° C. and 130° C. When using the illustrated beneath heating of the transfer member, it is desirable for the blanket to have relatively high thermal capacity and low thermal conductivity, so that the temperature of the body of the blanket 1102 will not change significantly as it moves between the optional pre-treatment station, the image forming system and the impression station(s). To apply heat at different rates to the ink image carried by the transfer surface, external heaters or energy sources (not shown) may be used to apply additional energy locally, for example prior to reaching the impression stations to render the ink residue tacky, prior to the image forming system to dry the optional pre-treatment agent and at the image forming system to start evaporating the carrier from the ink droplets as soon as possible after they impact the surface of the blanket.

The external heaters may be, for example, hot gas or air blowers or radiant heaters focusing, for example, infra red radiation onto the surface of the blanket, which may attain temperatures in excess of 175° C., 190° C., 200° C., 210° C., or even 220° C.

If the ink contains components sensitive to ultraviolet light then an ultraviolet source may be used to help cure the ink as it is being transported by the blanket.

Substrate Transport System

Figure 6:
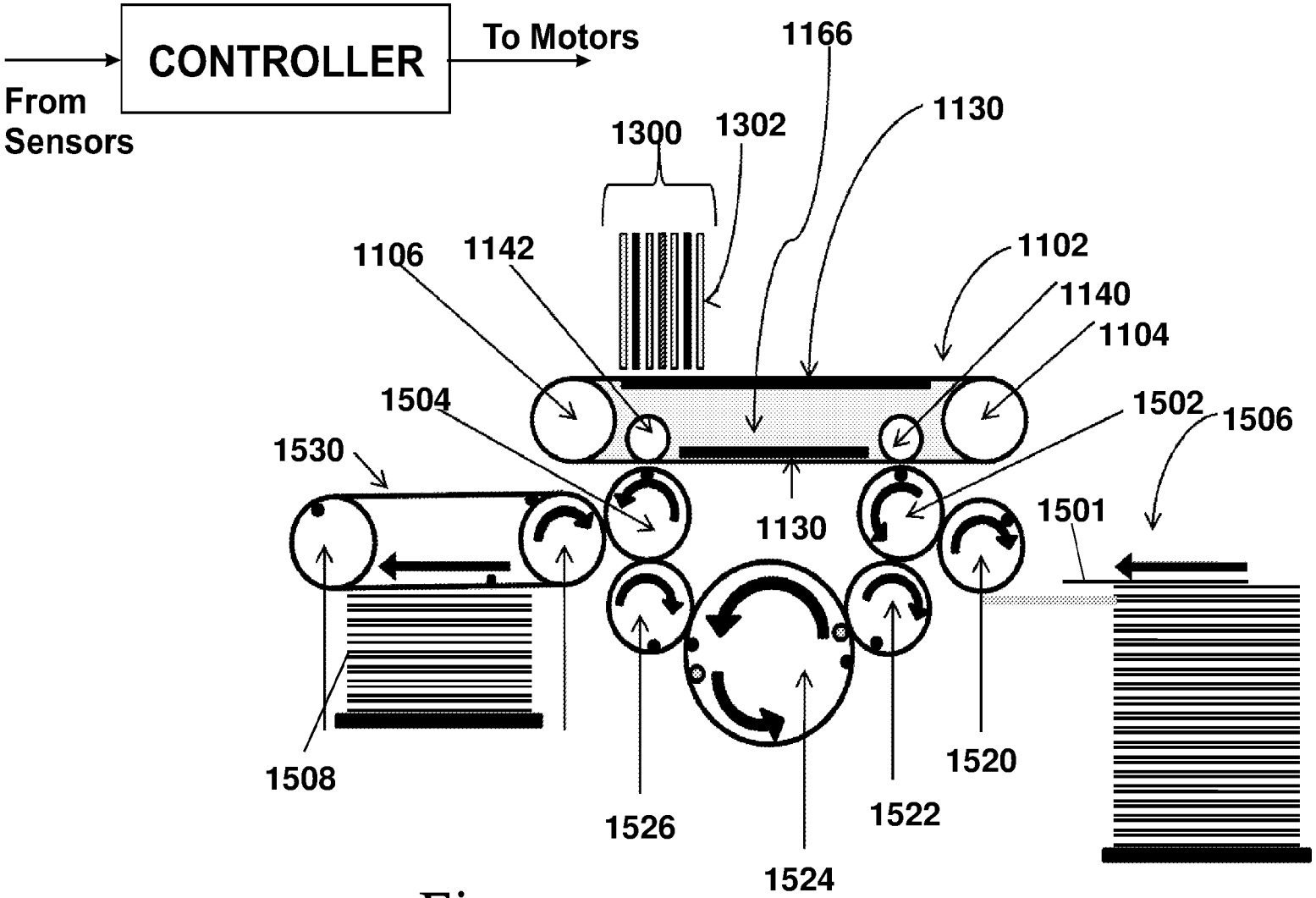
FIG. 6 is a schematic vertical section through the printing system of FIG. 5, in which the various components of the printing system are not drawn to scale.

In FIGS. 5 and 6, individual sheets are advanced, for example by a reciprocating arm, from the top of an input stack 1506 to a first transport roller 1520 that feeds the sheet to the first impression cylinder 1502.

Though not shown in the drawings, but known per se, the various transport rollers and impression cylinders may incorporate grippers that are cam operated to open and close at appropriate times in synchronism with their rotation so as to clamp the leading edge of each sheet of substrate. In an embodiment of the invention, the tips of the grippers at least of impression cylinders 1502 and 1504 are designed not to project beyond the outer surface of the cylinders to avoid damaging blanket 1102.

After an image has been impressed onto one side of a substrate sheet during passage between impression cylinder 1502 and blanket 1102 applied thereupon by pressure roller 1140, the sheet is fed by a transport roller 1522 to a perfecting cylinder 1524 that has a circumference that is twice as large as the impression cylinders 1502, 1504. The leading edge of the sheet is transported by the perfecting cylinder past a transport roller 1526, of which the grippers are timed to catch the trailing edge of the sheet carried by the perfecting cylinder and to feed the sheet to second impression cylinder 1504 to have a second image impressed onto its reverse side. The sheet, which has now had images printed onto both its sides, is advanced by a belt conveyor 1530 from second impression cylinder 1504 to output stack 1508.

Figure 9:
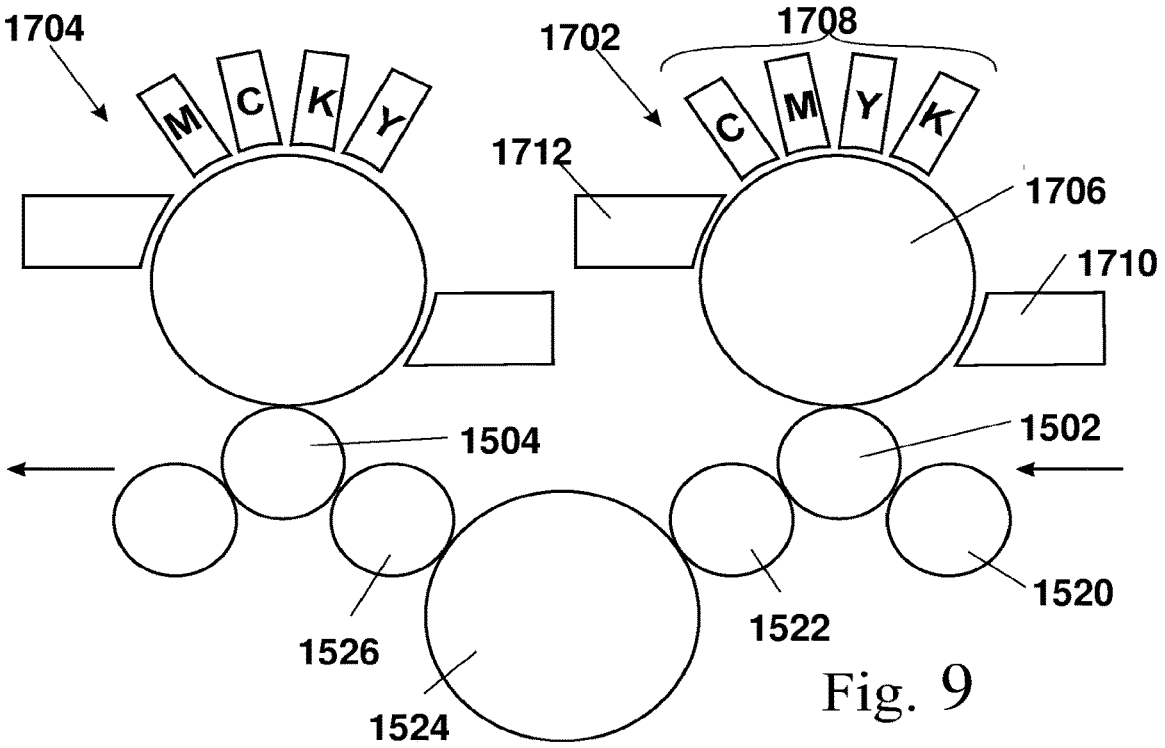
FIG. 9 is a schematic representation of a second embodiment of the invention when operating in duplex perfecting mode.
Figure 10:
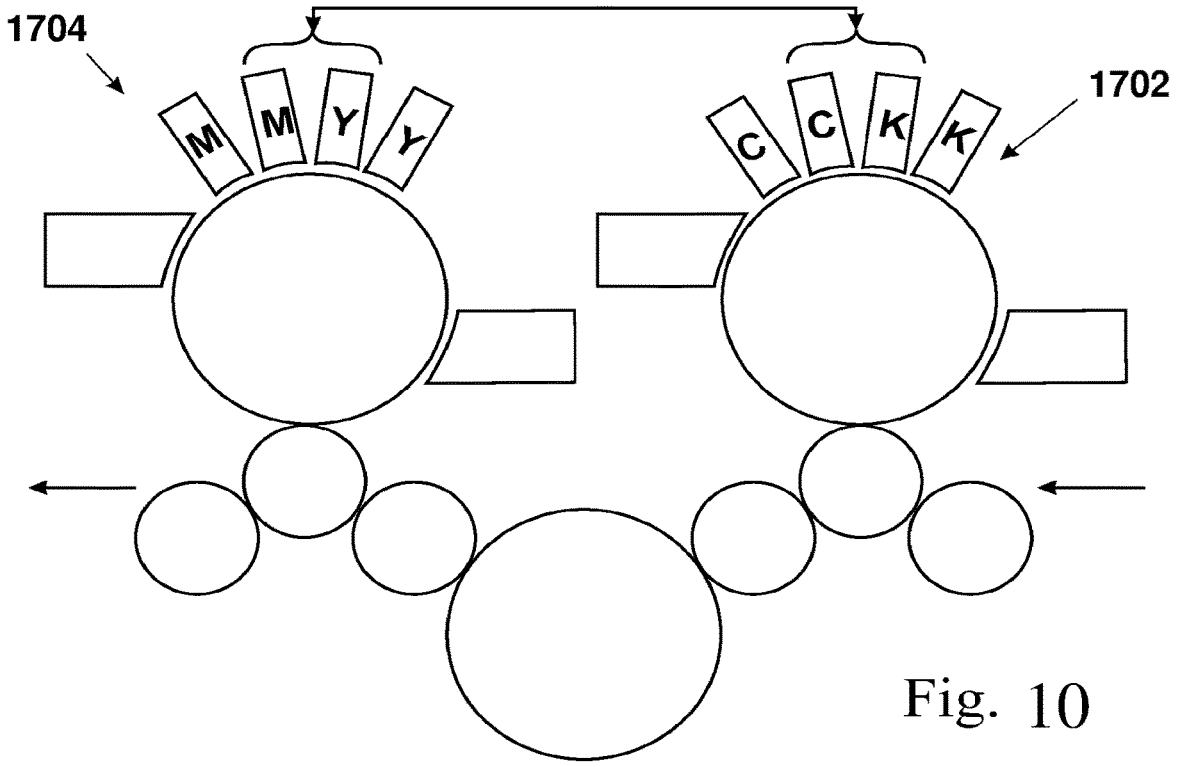
FIG. 10 is a similar schematic representation of the embodiment of FIG. 9, when operating in simplex full color mode.
Figure 11:
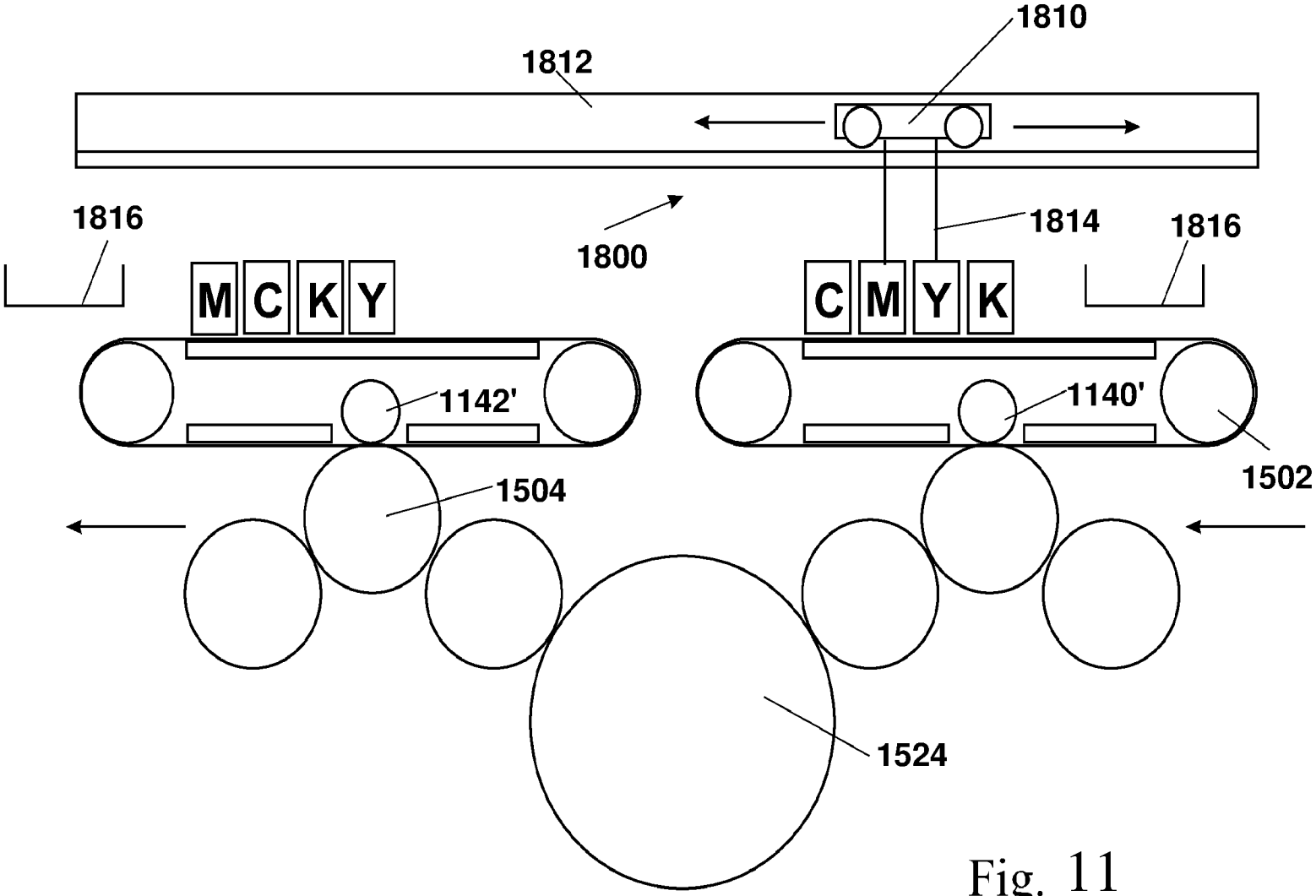
FIG. 11 is a schematic representation of a third embodiment of the invention, generally similar to the embodiment of FIG. 9, save that the intermediate transfer member is constructed as a blanket instead of a drum and an automated print bar positioning system is provided.

Discussion of FIGS. 9 to 11

Referring now to the embodiment of the invention shown in FIGS. 9 and 10, it will be seen that the substrate transport system is essentially the same as already described by reference to FIG. 6 and the same reference numerals have been used in order to avoid repetition of their description.

The ensuing description of the embodiment of FIGS. 9 and 10 will concentrate on the features that differ from what has previously been taught in U.S. Provisional Patent Application No. 61/606,913 and described above by reference to FIGS. 5 to 8.

The printing system comprises two printing towers 1702 and 1704. The tower 1702 comprises an image transfer drum 1706, an image forming system 1708 including four print bars (it can have more), a heating station 1710 following the image forming system 1708 in the direction of rotation of the drum 1706 and a pre-treatment station 1712 preceding the image forming system 1708, the pre-treatment being optional. In addition to external heating station 1710, the drum 1706 may be internally heated. The drum, which may be internally heated, carries a blanket of which the water impervious outer surface is optionally pre-treated in the pre-treatment station 1712 before it arrives at the image forming system 1708. The image forming system 1708 forms an image made up of ink droplets on the surface of the blanket. The image is dried and rendered tacky as it travels around the axis of the drum 1706 to form a thin residue film that is impressed onto a sheet substrate passing between the drum 1706 and the impression cylinder 1502.

Other than the blanket being wrapped around a drum 1706, instead of being guided over rollers, and interacting with only one impression cylinder 1502 instead of two, the printing system operates in the same way as already described with reference to FIGS. 5 to 8. In the light of the preceding description of FIGS. 5 to 8, it is believed that the construction and operation of the embodiment of the invention in FIGS. 9 and 10 will be self-evident and in no need of detailed explanation. In particular, the function served by the optional pre-treatment station 1712, the blanket surrounding the drum 1706 and the heating station 1710 and their construction are essentially as earlier described and further detailed in the referenced PCT Applications.

The use of a drum in place of guide rollers to support the blanket simplifies the control system as the blanket is not prone to stretching and the large moment of inertia of the drum reduces fluctuations in speed. The exact determination of the position of the blanket therefore requires fewer sensors and these may take the form of shaft encoders and/or sensors detecting one or more markings on the surface of the blanket.

In the illustrated configuration of the print bars in FIG. 9, the tower 1702 prints an image in full color onto one side of each substrate sheet. Each substrate sheet is then flipped over by the perfecting cylinder 1524, enabling a second image to be printed on its reverse side by the second tower 1704.

In the configuration shown in FIG. 10, each of the towers is configured to print a partial image comprising only two of the four required color separations. Thus, the tower 1702 printing only the Key (black) and Cyan color separations while the tower 1704 prints in the Magenta and Yellow color separations. The printing of the two towers is synchronized, as is known from offset lithography, so that the two partial images are in correct register with one another.

When operating in this manner, any tower serving to print only selected separations of an image, may include a plurality of print bars of the same color circumferentially spaced from one another along the image transfer surface. As each printing bar is limited as to the frequency with which it can direct ink droplets onto the intermediate transfer member, increasing the number of print bars of the same color permits a printing tower to operate at a higher speed while maintaining the same dot density in the image.

It would in principle be possible when operating in high speed simplex mode, for each tower to continue to print a full color partial image. However, achieving registration of dots of the same color printed by different towers is more difficult than registration of dots of different colors. It is therefore preferred when operating in simplex mode, to print each color separation using only one tower, so that for four color printing two colors are printed by the first tower and the other two by the second tower.

It will be noted that in FIG. 9, the order of the print bars in tower 1702 (CMYK) is different from the order in tower 1704 (MCKY). In particular, in each tower the colors of the two inner print bars match the colors of the two outer print bars of the other tower. The reason for this is that a changeover from perfecting mode to high speed simplex mode can be carried out interchanging only the inner pairs of print bars of the two towers, as represented by the arrows in FIG. 10.

The embodiment of FIG. 11 is generally similar to that of FIG. 10 save that the blanket, in common with the printing press shown in FIGS. 5 to 8, is guided around rollers instead of being wrapped around a drum. Each tower is therefore constructed in the same manner as described by reference to FIGS. 5 to 8, save that the blanket support system of each tower has only one pressure nip or roller 1140' or 1142'. In the case of the printing system described in FIGS. 5 to 8, the pressure rollers 1140, 1142 need to be disengageable from their impression cylinders to allow a film residue image intended for the second impression cylinder 1504 to pass unchanged over the first impression cylinder 1502. In the case of the embodiment of the invention in FIG. 11, as the two images are transported by different blankets, it is not essential for the nip rollers 1140', 1142' to be disengageable from their respective impression cylinders, though permitting movement of the nip rollers may be desirable to assist in allowing a belt seam to pass through the nip.

FIG. 11 also shows schematically an automated print bar positioning system 1800 that may be used to simplify changeover between the duplex and simplex modes. The system 1800 comprises a motorized carriage 1810 guided by rails 1812 and having lifting arms 1814 for raising printing bars and transferring them between towers. At least one parking station 1816 is also provided (two are shown in FIG. 11) for temporarily holding the print bars during the course of a changeover. Thus to convert from the illustrated CMYK, MCKY configuration to a CCKK, MMYY configuration, the carriage 1810 would first raise the MY print bars from the first tower and place them in a parking station 1816. Next the CK print bars would be raised from the second tower and transferred to the vacant intermediate positions in the first tower (hence forming a CCKK array). Finally, the MY print bars are transferred from the parking station 1816 to occupy the now vacant intermediate positions in the second tower (hence forming a MMYY array).

The contents of all of the above mentioned applications of the Applicant are incorporated by reference as if fully set forth herein.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs "comprise", "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "an impression station" may include more than one such station.

The invention claimed is:

1. A printing system for printing on a substrate, comprising:

a movable intermediate transfer member in the form of a flexible, substantially inextensible, thin belt whose compressible layer has a thickness of at most 400 micrometers, the belt being guided to follow a closed path, an image forming station for depositing droplets of a liquid ink onto an outer surface of the belt to form an ink image, a drying station for drying the ink image on the belt to leave an ink residue film on the outer surface of the belt, first and second impression stations spaced from one another in the direction of movement of the belt, each impression station comprising an impression cylinder for supporting and transporting the substrate and a pressure cylinder carrying a thick compressible blanket for urging the belt against the substrate supported on the impression cylinder, a thickness of the compressible blanket at least 1 mm; and a transport system for transporting the substrate from the first impression station to the second impression station.

2. A printing system as claimed in claim 1, wherein, in each impression station, the blanket on the pressure cylinder is continuous and a lifting mechanism is provided to lower the pressure cylinder into the first position and to raise the pressure cylinder for into the second position.

3. A printing system as claimed in claim 1, wherein in each impression station, the blanket extends only partially around the circumference of the pressure cylinder to leave a gap between the ends of the blanket, the pressure cylinder being rotatable from the first position in which the blanket is aligned with and urged towards the impression cylinder and the second position in which the gap between the ends of the blanket is aligned with the impression cylinder.

4. A printing system as claimed in claim 3, wherein the length of the blanket is equal to or greater than the maximum size of ink images formed on the intermediate transfer member.

5. A printing system of claim 1, wherein the pressure cylinder of at least the first impression station is movable between a first position in which the belt is urged towards the impression cylinder to cause the residue film on the outer surface of the belt to be transferred onto the front side of the substrate supported on the impression cylinder, and a second position in which the belt is spaced from the impression cylinder to allow the ink image on the belt to pass through the first impression station and arrive intact at the second impression station for transfer onto the reverse side of the substrate supported on the second impression cylinder.

6. A printing system as claimed in claim 1, wherein the transport system includes a perfecting system for selectively inverting the substrate during transportation between the two impression stations.

7. A printing system as claimed in claim 6, wherein substrate is in the form of a web and the perfecting system is designed to transport and invert the web between impression stations.

8. The printing system of claim 5, further comprising a treatment station situated between the second impression station and the image forming station, the treatment station configured to apply a treatment agent comprising polyethylenimine (PEI) onto the outer surface of the belt after the belt outer surface passes through the impression stations, thereby pre-treating the belt outer surface before subsequent formation thereon of the ink image.

9. The printing system of claim 8, wherein the treatment agent is for assisting in fixing droplets of liquid ink deposited on the belt at the image forming station.

10. The printing system of claim 8, wherein the applying of the treatment agent is for cooling the belt.

11. The printing system of claim 1, wherein the thickness of the compressible blanket is at most 6 mm.

12. The printing system of claim 1, wherein the thickness of the compressible layer of the thin belt is at least 100 micrometers.

* * * * *